US007891292B2

(12) United States Patent
Takahashi

(10) Patent No.: US 7,891,292 B2
(45) Date of Patent: Feb. 22, 2011

(54) PRINTING METHOD AND PRINTING APPARATUS

(75) Inventor: Mituru Takahashi, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 730 days.

(21) Appl. No.: 11/846,831

(22) Filed: Aug. 29, 2007

(65) Prior Publication Data

US 2008/0127841 A1 Jun. 5, 2008

(30) Foreign Application Priority Data

Nov. 30, 2006 (JP) ..... 2006-324537

(51) Int. Cl.
*B41L 13/04* (2006.01)

(52) U.S. Cl. ..... 101/116; 101/486

(58) Field of Classification Search ..... 101/114, 101/116, 118, 119, 127, 128.1, 129, 248, 101/485, 486

See application file for complete search history.

(56) References Cited

U.S. PATENT DOCUMENTS 6,065,397 A * 5/2000 Sato ..... 101/118
6,334,719 B1 * 1/2002 Kimura ..... 400/54
6,356,293 B1 * 3/2002 Chiba ..... 347/262
6,427,586 B2 * 8/2002 Takahashi ..... 101/116
7,275,481 B2 * 10/2007 Chiba et al. ..... 101/116

FOREIGN PATENT DOCUMENTS

JP 8-216381 8/1996
JP 2002-361994 12/2002
JP 2006192835 A * 7/2006

* cited by examiner

*Primary Examiner*—Ren Yan
(74) *Attorney, Agent, or Firm*—Oblon, Spivak, McClelland, Maier & Neustadt, L.L.P.

(57) ABSTRACT

A printing method and a printing apparatus including a stencil printing apparatus and so on. Focusing on the relationship that exists between copy number and master position displacement that occurs during printing, by determining by pretest and setting top-bottom shift correction values in accordance with parameters including copy number that affect printed master position displacement in the direction of rotation of a plate cylinder, and during printing, utilizing conventionally used top-bottom shift means to automatically execute top-bottom shift correction in accordance with the set top-bottom shift correction values, printing position displacement can be prevented from occurring, waste of master and printing medium such as paper can be eliminated and, in addition, the operation time can be shortened and the number of operation steps can be reduced. The CPU of control means, each time the copy number counted by a paper discharge sensor reaches a predetermined copy number, reads a top-bottom shift correction value corresponding to a predetermined copy number from a ROM, and during printing, controls a top-bottom shift motor of top-bottom shift means to execute a top-bottom shift correction in accordance with the read top-bottom shift correction value.

9 Claims, 20 Drawing Sheets

FIG. 7

| PRINTING CONDITION | TYPE |
|---|---|
| INK COLOR | |
| | BLACK INK |
| | RED INK |
| | BLUE INK |
| | GREEN INK |
| | DARK BLUE INK |
| | PURPLE INK |
| DRUM TYPE | |
| | A3 DRUM |
| | A4 DRUM |
| | DLT DRUM |
| PRINTING SPEED | |
| | 1-SPEED PRINTING |
| | 2-SPEED PRINTING |
| | 3-SPEED PRINTING |
| | 4-SPEED PRINTING |
| | 5-SPEED PRINTING |
| PAPER TYPE | |
| | THIN PAPER |
| | STANDARD PAPER |
| | THICK PAPER |
| INK TEMPERATURE | |
| | LOW TEMPERATURE (18°C OR LESS) |
| | NORMAL TEMPERATURE (19 TO 29°C) |
| | HIGH TEMPERATURE (30°C OR MORE |
| MASTER TYPE | |
| | A (STANDARD) |
| | B (DURABLE) |
| | C (COST-DOWN) |
| SELECTION PATTERN | |
| | PATTERN 1 |
| | ~ |
| | PATTERN 10 |

FIG. 8

| PRINTING CONDITION | | | | | PATTERN SELECTION | |
|---|---|---|---|---|---|---|
| INK COLOR | DRUM TYPE | PAPER TYPE | MASTER TYPE | INK TEMP. | PRINTING SPEED | SELECTED PATTERN |
| BLACK INK | A3 DRUM | THIN PAPER | A (STANDARD) | LOW TEMPERATURE | 1-SPEED PRINTING | PATTERN 1 |
| | | | | | 2-SPEED PRINTING | PATTERN 1 |
| | | | | | 3-SPEED PRINTING | PATTERN 2 |
| | | | | | 4-SPEED PRINTING | PATTERN 2 |
| | | | | | 5-SPEED PRINTING | PATTERN 3 |
| BLACK INK | A3 DRUM | THIN PAPER | A (STANDARD) | NORMAL TEMPERATURE | 1-SPEED PRINTING | PATTERN 2 |
| | | | | | 2-SPEED PRINTING | PATTERN 2 |
| | | | | | 3-SPEED PRINTING | PATTERN 3 |
| | | | | | 4-SPEED PRINTING | PATTERN 3 |
| | | | | | 5-SPEED PRINTING | PATTERN 4 |
| BLACK INK | A3 DRUM | THIN PAPER | A (STANDARD) | NORMAL TEMPERATURE | 1-SPEED PRINTING | PATTERN 3 |
| | | | | | 2-SPEED PRINTING | PATTERN 3 |
| | | | | | 3-SPEED PRINTING | PATTERN 4 |
| | | | | | 4-SPEED PRINTING | PATTERN 4 |
| | | | | | 5-SPEED PRINTING | PATTERN 5 |
| ⋮ | ⋮ | ⋮ | ⋮ | ⋮ | | |
| RED INK | A3 DRUM | STANDAR PAPER | A (STANDARD) | NORMAL TEMPERATURE | 1-SPEED PRINTING | PATTERN 2 |
| | | | | | 2-SPEED PRINTING | PATTERN 3 |
| | | | | | 3-SPEED PRINTING | PATTERN 3 |
| | | | | | 4-SPEED PRINTING | PATTERN 4 |
| | | | | | 5-SPEED PRINTING | PATTERN 4 |
| ⋮ | ⋮ | ⋮ | ⋮ | ⋮ | | |
| PURPLE INK | A3 DRUM | STANDARD PAPER | A (STANDARD) | NORMAL TEMPERATURE | 1-SPEED PRINTING | PATTERN 2 |
| | | | | | 2-SPEED PRINTING | PATTERN 3 |
| | | | | | 3-SPEED PRINTING | PATTERN 3 |
| | | | | | 4-SPEED PRINTING | PATTERN 3 |
| | | | | | 5-SPEED PRINTING | PATTERN 4 |

FIG. 9

COPY NUMBER AND PATTERN SELECTION

| COPY NUMBER | PATTERN 1 CORRECTION VALUE | PATTERN 2 CORRECTION VALUE | PATTERN 3 CORRECTION VALUE | ..... | PATTERN 10 CORRECTION VALUE | ..... | PATTERN N CORRECTION VALUE |
|---|---|---|---|---|---|---|---|
| 1~ | 0.00 | 0.00 | 0.00 | | 0.00 | | 0.25 |
| 101~ | 0.25 | 0.25 | 0.25 | | 0.50 | | 0.50 |
| 201~ | 0.50 | 0.25 | 0.25 | | 1.00 | | 0.50 |
| 301~ | 0.75 | 0.50 | 0.25 | | 1.50 | | 0.50 |
| 401~ | 1.00 | 0.50 | 0.50 | | 2.00 | | 0.50 |
| 501~ | 1.25 | 0.75 | 0.50 | | 2.50 | | 1.00 |
| 601~ | 1.50 | 0.75 | 0.50 | | 2.50 | | 1.00 |
| 701~ | 1.75 | 1.00 | 0.75 | | 2.50 | | 1.00 |
| 801~ | 2.00 | 1.00 | 0.75 | | 2.50 | | 1.00 |
| 901~ | 2.25 | 1.25 | 0.75 | | 2.50 | | 1.00 |
| 1001~ | 2.50 | 1.25 | 1.00 | | 2.50 | | 1.25 |
| 1101~ | 2.50 | 1.50 | 1.00 | | 2.50 | | 1.25 |
| ⋮ | ⋮ | ⋮ | ⋮ | | | | |
| 2301~ | 2.50 | 2.50 | 2.25 | | 2.50 | | 1.50 |
| 2401~ | 2.50 | 2.50 | 2.50 | | 2.50 | | 1.50 |
| 2501~ | 2.50 | 2.50 | 2.50 | | 2.50 | | 1.50 |
| 2601~ | 2.50 | 2.50 | 2.50 | | 2.50 | | 1.50 |
| 2701~ | 2.50 | 2.50 | 2.50 | | 2.50 | | 1.50 |
| 2801~ | 2.50 | 2.50 | 2.50 | | 2.50 | | 1.50 |
| 2901~ | 2.50 | 2.50 | 2.50 | | 2.50 | | 1.50 |
| 3001~ | 2.50 | 2.50 | 2.50 | | 2.50 | | 1.50 |

PRINTING METHOD AND PRINTING APPARATUS

BACKGROUND OF THE INVENTION

1. Field of the Invention

The present invention relates to a printing method, and to a printing apparatus including a stencil printing apparatus or the like.

2. Description of the Related Art

A digital thermosensitive stencil printing apparatus is a conventionally known type of printing apparatus that uses a simple printing method. In an apparatus of this type, a thermal head comprising a large number of minute exothermic elements is brought into contact with a master comprising a thermoplastic resin film adhered to a porous substrate and, after a perforation image is thermally fused in the thermoplastic resin of the master in accordance with image information to form a perforated printed plate as a result of a pulsating current being caused to flow to these exothermic elements while the master is being conveyed by conveyance means such as a platen roller, the printed master is wound around the outer circumferential surface of a plate cylinder of a printing drum in which a porous cylindrical plate cylinder is provided as the outer circumferential portion, a printing paper serving as a printing medium is pressed by pressing means against the outer circumferential surface of the plate cylinder, and ink is exuded through perforations on the plate cylinder and through the perforations of the master is transferred onto the printing paper to form a printed image on the printing paper (see, for example, Japanese Laid-Open Patent Publication Nos. H8-216381 and 2002-361994).

Hereinafter in the specification, reference to the plate cylinder shall include the printing drum, and the printing paper shall be referred to simply as "paper".

However, in printing carried out using a stencil printing apparatus as described above employing the same printed master, the position of the master clamped onto and wrappingly held around the plate cylinder gradually displacements in the direction of rotation of the plate cylinder as the copy number increases over the course of the printing. Printing carried out with this "master position displacement" state unnoticed leads to printed image position displacement with respect to the paper in the paper conveyance direction (hereinafter also referred to as the "top-bottom direction"). Printed image position on the paper is confirmed only upon completion of the printing and, accordingly, printed image displacement is revealed only when the printing is already finished.

Furthermore, gradual position displacement of the printed image (hereinafter also referred to as "printing position displacement") occurs for a different reason in printing carried out using a stencil printing apparatus as described above employing the same printed master. That is to say, a phenomenon known as "master stretch" in which the master clamped onto the plate cylinder gradually stretches occurs as the copy number increases. Printing position displacement due to master stretch necessitates reprinting.

Because the printing position displacement caused by the master position displacement described above requires reprinting and, as a result, necessitates further plate making and additional printing on paper employing the new printed master, the time taken therefor, as well as the master employed for the plate making and the paper employed for the printing, is wasted.

SUMMARY OF THE INVENTION

With the foregoing conditions in view, it is a main object of the present invention to provide a printing method and a printing apparatus in which, focusing on the relationship between copy number and master position displacement during printing, by setting a top-bottom shift correction value determined by pretesting in accordance with parameters including copy number that affect the position displacement of a printed master in the direction of rotation on a plate cylinder and, in accordance with this set top-bottom shift correction value, utilizing a conventionally used top-bottom shift means during printing to automatically execute a top-bottom shift correction, printing position displacement can be prevented, wasteful use of the master and printing medium (paper) can be eliminated, the operation time can be shortened, and the number of operation steps can be decreased.

It is a second object of the present invention to provide a printing apparatus in which, by obtaining master trailing-edge position data by detection of a trailing-edge position of a printed master on a plate cylinder as required and determining a master position displacement amount by performing a calculation based on this master trailing-edge position data, that is to say, reckoning a difference obtained by subtracting the master length pertaining to the master trailing-edge position detected as required from the master length pertaining to the master trailing-edge position when printing is started which serves as a reference as a master position displacement amount and determining a top-bottom shift correction value from this master position displacement amount, and utilizing a conventionally used top-bottom-shift means during printing to automatically execute a top-bottom shift correction in accordance with the determined top-bottom shift correction, printing position displacement can be prevented, wasteful use of the master and printing medium (paper) can be eliminated, the operation time can be shortened, and the number of operation steps can be decreased.

In addition, it is a third object of the present invention to provide a printing apparatus in which, by employing a master on which a marking for detection of master length has been printed and obtaining master length data by detection of a mark position pertaining to master length of a printed master on a plate cylinder as required, determining a master position displacement amount by performing a calculation based on this master length data, that is to say, reckoning a difference obtained by subtracting the master length detected as required from the master length when printing is started which serves as a reference as a master position displacement amount and determining a top-bottom shift correction value from this master position displacement amount, and utilizing a conventionally used top-bottom shift means during printing to automatically execute a top-bottom shift correction in accordance with the determined top-bottom shift correction, printing position displacement can be prevented, wasteful use of the master and printing medium (paper) can be eliminated, the operation time can be shortened, and the number of operation steps can be decreased.

In addition, it is a fourth object of the present invention to provide a printing apparatus in which, by provision in a plate-making device of marking means for printing a mark for detection of master length on a master, obtaining master length data by detection of a mark position pertaining to master length of a printed master on a plate cylinder as required and determining a master position displacement amount by performing a calculation based on this master length data, that is to say, reckoning a difference obtained by subtracting the master length detected as required from a master length when printing is started which serves as a reference and determining a top-bottom shift correction value from this master position displacement amount, and utilizing a conventionally used top-bottom shift means during printing to automatically execute a top-bottom shift correction in accordance with the determined top-bottom shift correction, printing position displacement can be prevented, wasteful use of the master and printing medium (paper) can be eliminated, the operation time can be shortened, and the number of operation steps can be decreased.

In an aspect of the present invention, a printing method used by a printing apparatus which comprises a plate cylinder around which a printed master is wrapped and a top-bottom shift device for shifting a position of a printed image directly or indirectly transferred onto a printing medium from a printed master on the plate cylinder in a direction of conveyance of the printing medium. The printing method comprises the steps of presetting a top-bottom shift correction value in accordance with parameters including copy number that affect position displacement of the printed master in a direction of rotation of the plate cylinder, and during printing, causing the top-bottom shift device to automatically execute a top-bottom shift correction in accordance with the top-bottom shift correction value.

In another aspect of the present invention, a printing apparatus comprises a plate cylinder around which a printed master is wrapped; a top-bottom shift device for shifting a position of a printed image directly or indirectly transferred onto a printing medium from a printed master on the plate cylinder in a direction of conveyance of the printing medium; a copy number counting device for counting copy number; a storage device for storing a preset top-bottom shift correction value for each predetermined copy number; and a control device for, each time the copy number counted by the copy number counting device reaches the predetermined copy number, reading the predetermined copy number from the storage device and causing said top-bottom shift device to execute a top-bottom shift correction in accordance with the read the top-bottom shift correction value.

In another aspect of the present invention, a printing apparatus comprises a plate cylinder around which a printed master is wrapped; a top-bottom shift device for shifting a position of a printed image directly or indirectly transferred onto a printing medium from a printed master on the plate cylinder in a direction of conveyance of the printing medium; a master trailing edge detection device for detecting a trailing-edge position of a printed master on the plate cylinder; and a control device for computing a top-bottom shift correction value by performing a calculation based on master trailing edge data detected by the master trailing edge detection device, and during printing, causing the top-bottom shift device to execute the top-bottom shift correction in accordance with the computed top-bottom shift correction value.

In another aspect of the present invention, a printing apparatus comprises a plate cylinder which employs a master printed with a mark for detecting master length and around which this printed master is wrapped; a top-bottom shift device for shifting a position of a printed image directly or indirectly transferred onto a printing medium from a printed master on the plate cylinder in a direction of conveyance of the printing medium, the printed master being mounted so that, when wrapped around the plate cylinder, the mark is arranged on an upstream side in a direction of rotation of the plate cylinder; a master mark detection device for detecting the mark of a printed master on the plate cylinder; and a control device for computing a top-bottom shift correction value by performing a calculation based on master length data detected by the master mark detection device, and during printing, causing the bop-bottom shift device to execute the top-bottom shift correction in accordance with the computed top-bottom shift correction value.

In another aspect of the present invention, a printing apparatus comprises a platemaking device comprising a platemaking means for making a master and a marking means for printing a mark for detecting master length; a plate cylinder around which a printed master made by the platemaking means is wrapped; a top-bottom shift device for shifting a position of a printed image directly or indirectly transferred onto a printing medium from a printed master on the plate cylinder in a direction of conveyance of the printing medium, the printed master being mounted so that, when wrapped around the plate cylinder, the mark printed by the marking means is arranged on an upstream side in a direction of rotation of the plate cylinder; a master mark detection device for detecting the mark of a printed master on the plate cylinder; and a control device for computing a top-bottom shift correction value by performing a calculation based on master length data detected by the master mark detection device, and during printing, causing the top-bottom shift device to execute the top-bottom shift correction in accordance with the computed top-bottom shift correction value.

BRIEF DESCRIPTION OF THE DRAWINGS

The above and other objects, features and advantages of the present invention will become more apparent form the following detailed description taken with the accompanying drawings in which:

FIG. 2 is a front view of a main part of top-bottom shift means used by this first embodiment and so on;

FIG. 7 is a table for explaining print condition types serving as parameters;

FIG. 8 is a table for explaining patterns selected by combining the print conditions serving as parameters;

FIG. 9 is a diagram showing a data table of top-bottom shift correction values set in accordance with the patterns for each copy number;

DESCRIPTION OF THE PREFERRED EMBODIMENTS

Figure 20A:
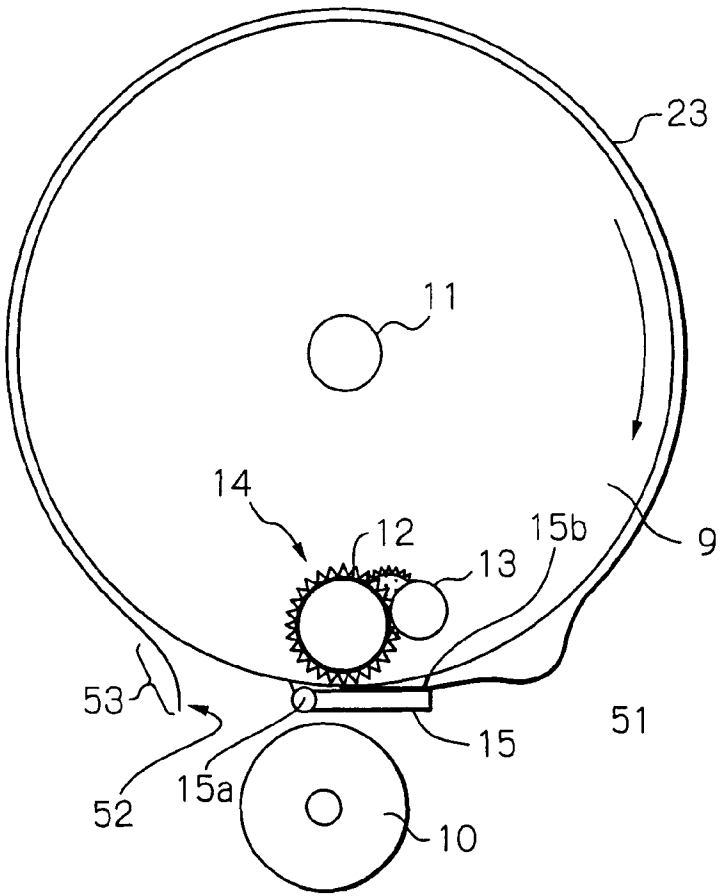
FIG. 20A is a cross-sectional view of a main part for explaining master position displacement conditions generated in a master on a plate cylinder.

First, referring to FIGS. 20A and 20B of the drawings, master position displacement in a printing apparatus will be described. Master position displacement is a fundamental problem in mechanical structures and systems such as printing apparatuses, and in particular in stencil printing apparatuses, in which as shown in FIG. 20A a printed master 23 is wound around the outer circumferential surface of a plate cylinder 9. That is to say, when the printed master 23 is wrapped around the outer circumferential surface of the plate cylinder 9, first, a leading-edge portion of the printed master 23 is clamped and held by a clamp 15 closeable by way of a clamping shaft 15*a* disposed on the plate cylinder 9, the printed master 23 then being wrapped around the outer circumferential surface of the plate cylinder 9 as a result of the plate cylinder 9 being rotated in the direction shown in the diagram (clockwise direction). A small initial-state deflection amount 51 exists in the printed master 23 subsequent to the initial wrapping thereof and, for machines and systems that employ a press roller 10 as pressing means, because the master 23 is pulled in the direction of rotation of the plate cylinder 9 when pressure is applied by the press roller 10 during printing due to the absence of a mechanism for rotationally driving the press roller 10, an unavoidable master position displacement that, in turn, results in printing position displacement occurs during the period until the initial-state deflection amount 51, as well as an initial-state stretch amount of the master 23 itself, is absorbed.

Because the position of the printed master 23 in which the initial-state deflection amount 51 is generated is normally a non-aperture portion of the plate cylinder 9 outside the range of an aperture portion (not shown in the diagram) thereof in which a large number of pores are provided, that is to say, the region of leading-edge portion of the printed master 23 that corresponds to the region in which the clamp 15 is arranged, a state in which the initial-state deflection amount 51 of the printed master 23 fails to be affixed to the outer circumferential surface of the plate cylinder 9 by the adhesive force of ink exuded though the open pores of the aperture portion is established.

Figure 20B:
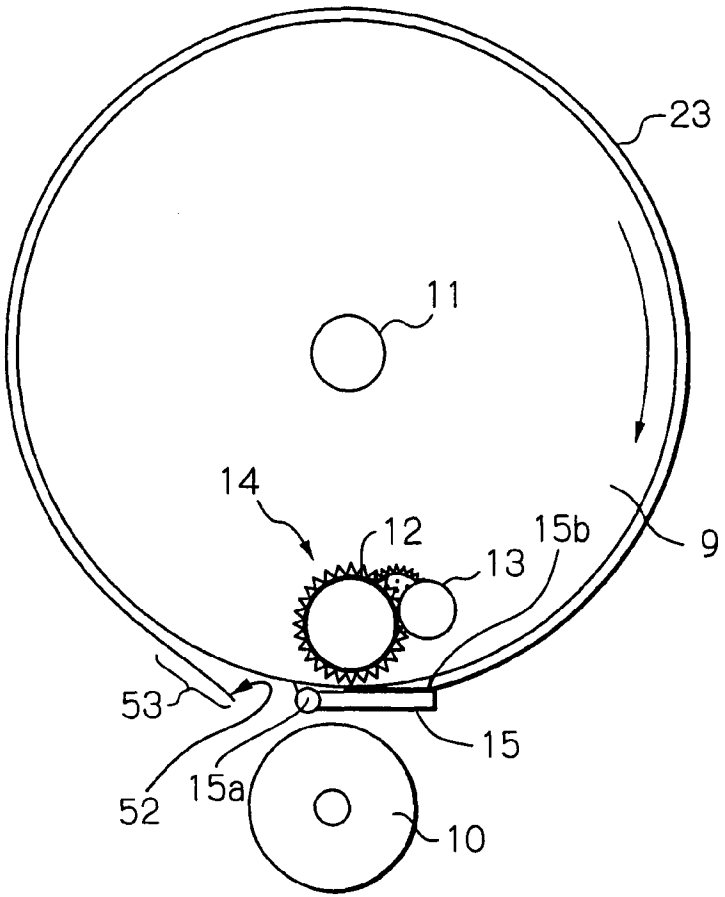
FIG. 20B is a cross-sectional view of a main part for explaining a state in which this master position displacement has been absorbed and the master is adhered closely to the plate cylinder.

As shown in FIG. 20B, when the initial-state deflection amount 51 and the initial-state stretch amount of the master 23 itself are absorbed a state in which, excluding a trailing-edge portion 53 of the printed master 23, the printed master 23 in the upstream side in the direction of rotation on the plate cylinder 9 from the initial-state deflection amount 51 is affixed to the outer circumferential surface of the plate cylinder 9 by the adhesive force of ink exuded through the aperture portion on the plate cylinder 9 is established.

Figure 1:
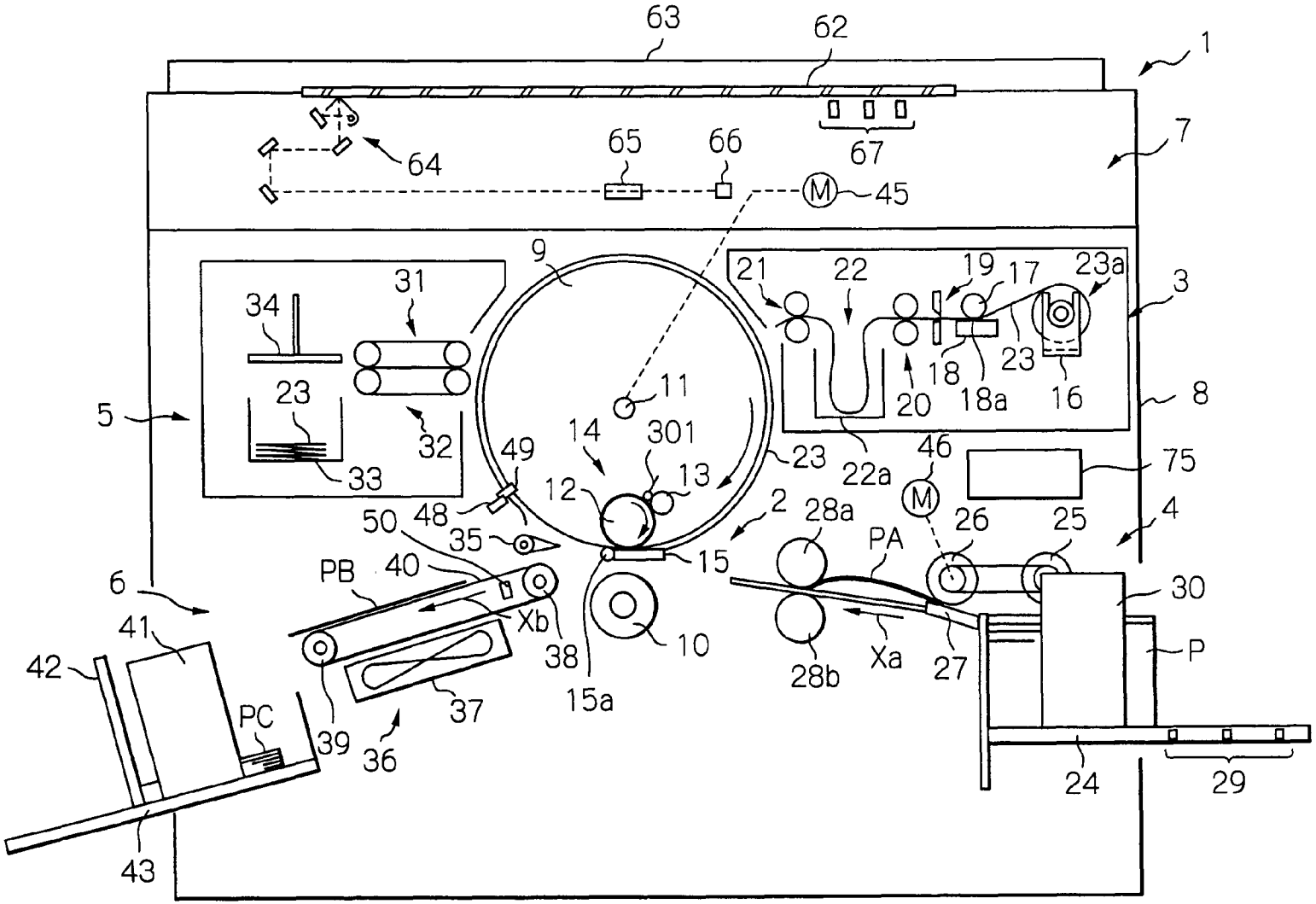
FIG. 1 is an abridged front view of the whole of a stencil printing apparatus of a first embodiment of the present invention.
Figure 10:
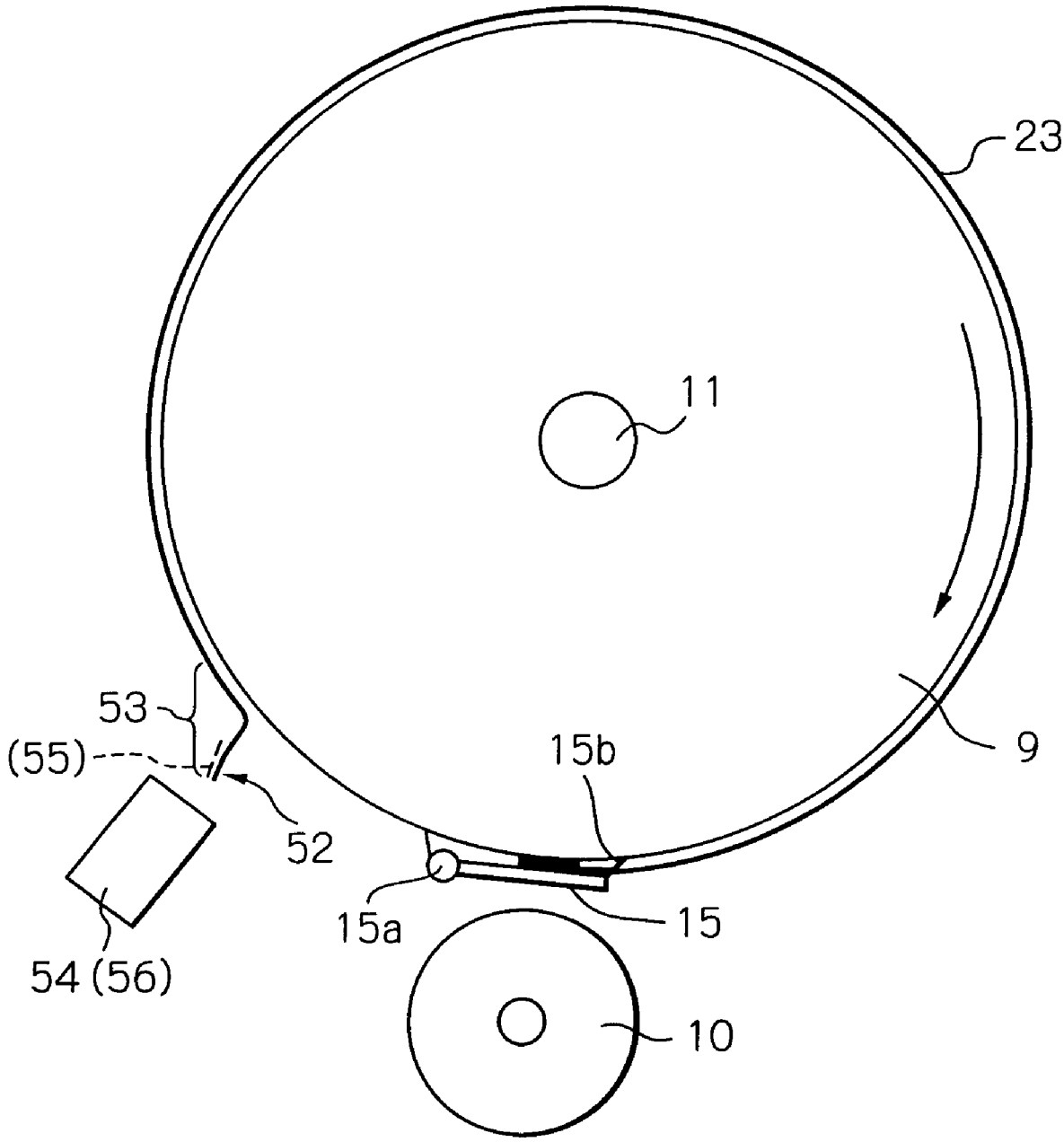
FIG. 10 is a schematic front view of second to fourth embodiments showing an example arrangement of a master trailing-edge sensor and mark position sensor for detecting the trailing-edge position and trailing edge mark position of a master on a plate cylinder.
Figure 12:
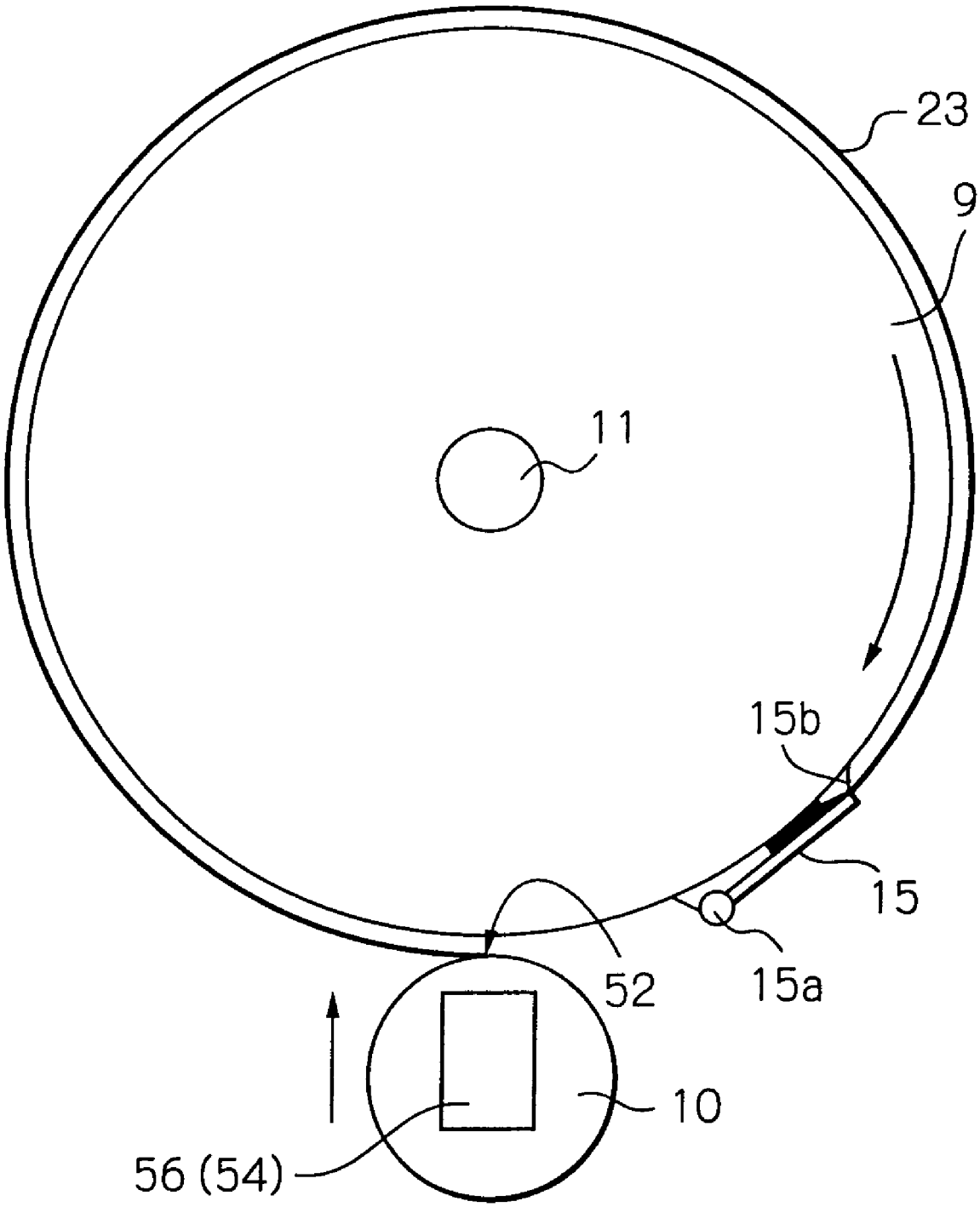
FIG. 12 is a schematic front view of modifications of each of the second to fourth embodiments showing another example arrangement of a master trailing-edge sensor and mark position sensor for detecting the trailing-edge position and trailing edge mark position of a master on a plate cylinder.

The symbol 52 in FIGS. 20A and 20B denotes the trailing edge of the printed master 23 wrapped around the outer circumferential surface of the plate cylinder 9. In FIG. 10 and FIG. 12, which incorporate FIGS. 20A and 20B and are used to explain the various embodiments, ink supply means 14 as shown in FIG. 1 has been omitted.

In addition, while in machines and systems in which an impression cylinder of outer diameter essentially the same as the outer diameter of a plate cylinder is employed as pressing means, the generation of creases (solid portion raised creases and so on of the printed master 23 on the plate cylinder 9) of the printed master 23 to the side in which the master is tensioned can be avoided by the diameter of the impression cylinder being formed slightly narrower than the diameter of the plate cylinder, experience and testing has revealed that an unavoidable master position displacement occurs during the period until the initial-state deflection amount 51 and the initial-state stretch amount due to the master 23 itself is absorbed and, in turn, that printing position displacement comparable to that produced using the press roller 10 occurs.

The best mode for carrying out the invention and the modes for embodying the present invention including the modifications thereof (hereinafter referred to as the "embodiments") will be hereinafter described with reference to the drawings. Constituent elements (members and constituent component parts) and so on of the embodiments and modifications thereof of the same shape and function are denoted by the same symbol and, once a description thereof has been given, a repetition of this description has been omitted. For reasons of simplification of the description, for constituent elements of the diagrams configured in pairs and for which there is no need for a special description for the two elements thereof to be distinguished, a single element only of the pair is described. For reasons of simplification of the diagrams and description, a description of constituent elements illustrated in the drawings for which there is no particular need for a description of the drawings thereof has been omitted as considered appropriate. In the parts of the description in which a constituent element of a publicly disclosed patent application or the like is cited, the relevant symbols have been given in parentheses to distinguish them from the constituent elements of the embodiments and so on.

First Embodiment

FIGS. 1 to 5 shows a first embodiment. First, referring principally to FIG. 1 that schematically shows the overall configuration of a digital thermosensitive stencil printing apparatus 1 that serves as one example of a printing apparatus in which the present invention has application, the characterizing configuration of the present invention will be described in detail.

As shown in the diagram, the stencil printing apparatus 1 comprises a printing unit 2, a platemaking unit 3, a plate supply unit 4, a plate discharge unit 5, a paper discharge unit 6, an image reading unit 7 and control means 75 and so on. The symbol 8 in the drawing denotes an apparatus main body that serves as a skeletal frame for mounting of the aforementioned units and their respective fittings.

The printing unit 2, which is arranged essentially in the center of the apparatus main body 8, comprises a plate cylinder 9 around the outer circumferential surface of which a printed master 23 is wrapped and a press roller 10 serving as pressing means for pressing a paper P directly against the printed master 23 on the plate cylinder 9 (hereinafter referred to as the "master 23 on the plate cylinder 9").

The plate cylinder 9, which comprises an aperture portion in which a large number of ink-permeable pores are formed and an ink non-permeable non-aperture portion, is supported with freedom to rotate in the direction of the arrow shown in the diagram around a supporting shaft 11. The non-aperture portion is formed in a later-described predetermined region around a clamp and two edge portions in the lateral direction on the plate cylinder 9. The specific configuration of the plate cylinder 9 is the same as the plate cylinder (1*a*) shown in, for example, FIG. 4 and so on of Japanese Laid-Open Patent Publication No. H11-138961.

The plate cylinder 9 is rotationally driven in the direction of the arrow in the diagram by a main motor 45 serving as plate cylinder drive means. The main motor 45 configured from, for example, a control DC motor, is controlled by a later-described control means so that the rotational speed thereof varies in accordance with printing speed. The configuration adopted for the plate cylinder drive mechanism serving as drive power transmission means that links the plate cylinder 9 and main motor 45 is the same as the drive mechanism (150) shown in, for example, FIG. 4 of Japanese Laid-Open Patent Publication No. 2004-155170.

The plate cylinder 9, which is configured as a plate cylinder unit (or drum unit) not shown in the diagram formed as an integrated unit with a later-described ink supply means, is configured with freedom to be detached by way of detachment means (not shown in the diagram) arranged in the apparatus main body 8. The aforementioned plate cylinder unit and detachment means are the same as the drum unit (100*a*) and detachment means (50*a*) shown in, for example, FIG. 3 of Japanese Laid-Open Patent Publication No. H11-138961.

A freely closable clamp 15 for nip-clamping a leading-edge portion of the master 23 is arranged on a generating line of the outer circumferential portion on the plate cylinder 9 around the outer circumferential surface of which the printed master 23 is wound. The clamp 15 is configured to be freely closeable by way of a clamp shaft 15*a* turnably affixed to a stage portion 15*b* provided in the non-aperture portion on the plate cylinder 9. The clamp 15 is opened and closed by opening/closing means not shown in the diagram subsequent to the plate cylinder 9 occupying a predetermined rotation position, a plate supply position at which the printed master is supplied, a plate discharge position at which the used master 23 on the plate cylinder 9 is peeled off, and a home position which serves as an initial-state position.

Ink supply means 14 comprising the supporting shaft 11 that serves additionally as an ink supply pipe, an ink roller 12 of which the outer circumferential surface is arranged adjacent to the inner circumferential surface of the plate cylinder 9, and a doctor roller 13 of which the outer circumferential surface is arranged adjacent to the ink roller 12 with a small gap therebetween and so on is arranged in the inner part of the plate cylinder 9. As described later, ink supply means 14 comprises a function for supplying ink from the inner side of the plate cylinder 9 to the master 23 on the plate cylinder 9. The ink supplied from the supporting shaft 11 that serves additionally as an ink supply pipe forms an ink reservoir in an adjacent portion between the ink roller 12 and doctor roller 13, and the ink of this ink reservoir is passed through a predetermined gap between the ink roller 12 and the doctor roller 13 and supplied in layers onto the outer circumferential surface of the ink roller 12. The ink supplied to the outer circumferential surface of the ink roller 12 is supplied to the inner circumferential surface of the plate cylinder 9 as a result of a pressing contact between the inner circumferential surface of the plate cylinder 9 and the ink roller 12 when the outer circumferential surface of the plate cylinder 9 is pressed by the press roller 10, and is exuded through the aperture portion on the plate cylinder 9 and transferred onto the paper P supplied from the plate supply unit 4. A preferably employed example of this ink is a W/O type emulsion ink.

A temperature sensor 301 serving as ink temperature detection means for detecting the temperature of the ink is arranged in the inner part of the plate cylinder 9 in the portion of ink supply means 14 formed as the ink reservoir. As the temperature sensor 301, a conventional thermistor that couples as thermistor for adjusting energy for platemaking and so on may be employed.

The press roller 10, of which both ends of a supporting shaft thereof are supported with freedom to rotate by a pair of arm members not shown in the diagram, is arranged below the plate cylinder 9. As a result of the two arm members not shown in the diagram being swung by swinging means not shown in the diagram, the press roller 10 is caused to selectively occupy a non-printing position separated from the outer circumferential surface of the plate cylinder 9 as shown in FIG. 1 and a print position where it is pressingly contacts the plate cylinder 9 at a predetermined pressure. As the aforementioned swinging means, a configuration the same as press roller displacement means (22) shown in, for example, FIG. 3 of Japanese Laid-Open Patent Publication No. 2004-155170 is adopted.

The platemaking unit 3 is arranged in the upper-right portion of the apparatus main body 8. The platemaking unit 3 comprises a master holding member 16, a platen roller 17, a thermal head 18, master cutting means 19, a master conveyance roller pair 20, reverse roller pair 21 and master stock means 22 and so on.

The master holding member 16, which is affixed to a unit side panel of the platemaking unit 3 not shown in the diagram, supports a core part of a master roller 23*a* around which the master 23 is wound in a roll shape with freedom to rotate and freedom to be detached.

The master 23 used in this embodiment is a laminate structure formed from, for example, a thermoplastic resin film and a porous substrate (based) configured from, for example, paper fibers, synthetic fibers or a mixture of paper fibers and synthetic fibers adhered thereto, while as the thermoplastic resin film a polyethylene teraphthalate (PET)-based film or the like is used. The thickness of the master 23 used in a stencil printing apparatus is normally of the order of 20 to 60 μm, the thickness of the thermoplastic resin film thereof being in the range 1.0 to 2.5 μm with the remaining thickness being configured by the porous substrate.

The master 23 used by a stencil printing apparatus is not limited to the material employed in this embodiment and examples of the master types that may be employed include, as listed in FIG. 7, a B (durable) specification master in which the stretch of the master itself is small and which exhibits excellent printing-proof performance in terms of being able to produce a greater copy number, and a C (cost-down) specification master of a in which manufacturing costs are prioritized over printing-proof number and image quality. In addition, a master of thin porous substrate may be used, the synthetic fiber base master (2) as described in, for example, Japanese Laid-Open Patent Publication No. H11-77949 may be used and, in addition, a master in which a molten resin is coated on a synthetic resin film to integrally form the resin film on the synthetic resin film, or a master configured essentially from a thermoplastic resin film may be used.

The platen roller 17 is supported with freedom to rotate in the aforementioned unit side panel at the left of the master holding member 16, the platen roller 17 being rotatably driven by a stepping motor not shown in the diagram fixed to the aforementioned unit side panel. The thermal head 18, which comprises a large number of exothermic elements 18*a*, is arranged below the platen roller 17. The surface of the exothermic elements 18*a* of the thermal head 18 are pressingly contacted against the outer circumferential surface of the platen roller 17 by the urging force of urging means not shown in the diagram. The thermal head 18 comprises a function as platemaking means for making a perforated master 23 based on, while in contact with the thermoplastic resin film surface of the master 23, position-selective generation of heat by the exothermic elements 18*a*.

Master cutting means 19 for cutting the master 23 in a predetermined length is arranged to the left of the platen roller 17 and the thermal head 18. Master cutting means 19, which comprises a fixed blade fixed to the aforementioned unit side panel and a shifting blade movably supported with respect to the fixed blade, cuts the master 23 as a result of either a rotational movement or a vertical movement of the shifting blade with respect to the fixed blade.

The master conveyance roller pair 20 and reverse roller pair 21 are arranged to the left of master cutting means 19, and master stock means 22 is arranged between these roller pairs 20, 21. The roller pairs 20, 21, which comprise a drive roller and a driven roller each supported with freedom to rotate in the aforementioned side panel, are each rotatably driven by mutually different drive means. Master stock means 22, which comprises a fan not shown in the diagram in its inner part, is configured in such a way that, as a result of the drive of the fan, the printed master 23 is able to be drawn into a flexible box 22*a* in the inner part thereof so that a 1-plate segment of the printed master 23 can be stocked. A master guide panel not shown in the diagram that selectively occupies a first guide position for guiding the master 23 being conveyed by the master conveyance roller pair 20 to the reverse roller pair 21, and a second guide position for guiding it into master stock means 22, is arranged in a part above master stock means 22. The reverse roller pair 21 comprises the function of plate supply means for feeding the printed master 23 to be supplied to the plate cylinder 9.

The plate supply unit 4 is arranged below the platemaking unit 3. The plate supply unit 4 comprises a paper supply tray 24 as a paper supply base, a paper supply roller 25, a separating roller 26, a separating pad 27 and resist roller pair 28 and so on.

The paper supply tray 24 is configured so that a large number of sheets of paper P are stackable on its upper surface and to be vertically moveable to be with respect to the apparatus main body 8. The paper supply tray 24 is vertically moved with an elevating motor (not shown in the diagram) by way of an elevating mechanism not shown in the diagram to be vertically moved accompanying increases and decreases in the amount of paper P. A pair of side fences 30 for aligning the paper P in the lateral direction is arranged on the upper surface of the paper supply tray 24 so as to be mutually movable, by way of a known rack-and-pinion mechanism, the same movement about in the width direction of the paper orthogonal to a direction of paper conveyance Xa. A length paper size detection sensor 29 serving as paper size detection means for detecting the length size of the paper P along the direction of paper conveyance Xa and a width paper size detection sensor not shown in the diagram serving as paper size detection means for detecting the width size of paper P in the direction of paper conveyance orthogonal with the direction of paper conveyance Xa are respectively arranged in plurality on the paper supply tray 24. The aforementioned width paper size detection sensor comprises a known configuration for detecting the width size of the paper P that is interlocked with the movement of the side fences 30 in the paper width direction. Control means 75 ascertains and determines paper size in accordance with a signal output from the length paper size detection sensor 29 and the aforementioned width paper size detection sensor (hereinafter these shall be generically referred to as "paper size detection sensor group 29").

The paper supply roller 25, which comprises a high-friction resistance member on its upper surface, is arranged above the left end of the paper supply tray 24. The paper supply roller 25, which is supported with freedom to rotate by a bracket not shown in the diagram supported with freedom to swing in the apparatus main body 8, pressingly contacts the uppermost paper P on the paper tray 24 at a predetermined pressure when the paper tray 24 is elevated. The paper supply roller 25 is linked to a separating roller 26 via a syncronous pulley and an endless syncronous belt, and is rotationally driven in synchronization with the rotation of the separating roller 26 in the same direction as the rotational direction of the separating roller 26.

The separating roller 26, which comprises a high-friction resistance member on its upper surface, is arranged to the left of the paper supply roller 25. The separating roller 26, which is linked to a paper supply motor 46 configured from a stepping motor by way of a drive force transmission means such as a gear or belt or the like, is rotationally driven by the paper supply motor 46 in synchronization with the rotation of the plate cylinder 9.

The separating pad 27, which is configured from a high-friction resistance member that pressingly contacts the circumferential surface of the separating roller 26, is arranged below the separating roller 26. The paper P is separately supplied in single sheets by a cooperative action performed by the separating roller 26 and separating pad 27.

The resist roller pair 28, which serves as feed means comprising a drive roller 28*a* and driven roller 28*b*, is arranged below the separating roller 26 and separating pad 27. The drive roller 28*a* is rotationally supported between side panels not shown in the diagram of the apparatus main body 8, and is rotationally driven at a predetermined supply timing in synchronization with the rotation on the plate cylinder 9 as a result of the transmission of a rotational drive force from a main motor 45 (plate cylinder drive means) by way of top-bottom shift means 250 shown in FIG. 2.

The plate discharge unit 5 is arranged in the upper-left part of the apparatus main body 8. The plate discharge unit 5 comprises an upper plate discharge member 31, a lower plate discharge member 32, a plate discharge box 33 and a compression plate 34 and so on.

The upper plate discharge member 31 and lower plate discharge member 32 comprise a driven roller, auxiliary roller and endless belt and the like respectively, the endless belt being moved as a result of the rotational drive of a drive roller by plate discharge drive means not shown in the diagram. In addition, the lower plate discharge member 32, which is configured to be movable by shift means not shown in the diagram, selectively occupies a standby position as shown in the diagram and a peeling position at which the endless belt abuts the outer circumferential surface of the plate cylinder 9.

The plate discharge box 33, in the inner part of which 15 the printed master 23 is stored, is configured with freedom to be detached from the apparatus main body 8. The compression plate 34, which increases the housed amount of the plate discharge box 33 by pushing down and compressing the printed master 23 transported by the upper plate discharge member 31 and lower plate discharge member 32 into the inner part thereof, is supported with freedom to move vertically in the apparatus main body 8 and to be vertically moved by elevation means not shown in the diagram.

The paper discharge unit 6 is arranged below the plate discharge unit 5. The paper discharge unit 6 comprises a peeling hook 35, paper discharge adsorption conveyance device 36 and paper discharge tray 43 as a discharge paper base and so on.

The peeling hook 35 constitutes a known mechanism swung by hook swinging means not shown in the diagram as a result of a base end thereof being supported with freedom to swing in the apparatus main body 8 that selectively occupies a peeling position at which, with the free end thereof formed in a conical shape in close proximity to the outer circumferential surface of the plate cylinder 9, the paper P is forcibly peeled off and separated from the master 23 on the plate cylinder 9, and a detached position at which it is detached from the outer circumferential surface of the plate cylinder 9 in order to avoid obstacles such as the clamp 15.

The paper discharge adsorption conveyance device 36 is arranged below and to the left of the peeling hook 35. The paper discharge adsorption conveyance device 36 comprises a function as discharge paper conveying means for conveying the printed paper P (which also constitutes the discharged paper PB shown in FIG. 1), that is, the paper peeled from the master 23 on the plate cylinder 9 on which an image has been formed, toward the paper discharge tray 43.

The paper discharge adsorption conveyance device 36 comprises a drive roller 39 axially supported with freedom to rotate in a discharge paper side panel not shown in the diagram, a drive roller 38 axially supported with freedom to rotate in the aforementioned paper discharge side panel, a plurality of endless belts 40 that span between the drive roller 39 and the driven roller 38, a suction fan 37 that sucks air from between the endless belts 40, and a belt drive motor not shown in the diagram as paper discharge drive means for rotationally driving the drive roller 39 and so on. Moreover, the peeling action of the paper P may be supported by arrangement of a peeling fan not shown in the diagram to the upper left of the peeling hook 35 to blow air toward the tip end, or the free end, of the peeling hook 35.

As a result of the rotational drive of the aforementioned belt drive motor by the paper discharge adsorption conveyance device 36 described above and, in addition, the actuation of the suction fan 37, the discharge paper PB is conveyed to the downstream side in a direction of paper discharge Xb while being pushed against the endless belt 40.

The paper discharge tray 43 is arranged in the downstream side of the direction of paper discharge Xb of the paper discharge adsorption conveyance device 36. The paper discharge tray 43 comprises a known configuration for stacking a large number of sheets of printed paper (discharge paper) PB conveyed and discharged by the paper discharge adsorption conveyance device 36. The paper discharge tray 43 comprises a single end fence 42 movable in the direction of paper discharge Xb for aligning the discharge paper PB on the upper surface thereof in the direction of paper discharge Xb, and a pair of side fences 41 moveable in synchronization by the same amount in a paper width direction Y orthogonal with the paper direction Xb for aligning the discharge paper PB in a paper width direction Y.

A paper discharge sensor 50 serving as copy number counting means for counting the number of copies of the paper P printed by the printing unit 2 is arranged in the vicinity of a bottom opening of the paper discharge adsorption conveyance device 36 between the plurality of endless belts 40. The paper discharge sensor 50, which is configured from, for example, a reflection-type photosensor, serves also as paper discharge detection means for detecting winding of the paper P on the plate cylinder 9 and paper discharge error.

Moreover, copy number counting means is not limited to the paper discharge sensor 50, and the number of revolutions of the paper supply motor 46 may be counted, a paper sensor for counting the number of supplied sheets of paper P based on detecting the leading edge of the paper P (known paper supply sensor or resistor sensor or the like) may be arranged in the paper discharge path of the paper supply unit 4, or the number of reciprocating movements and elevations of the press roller 10 of the printing unit 2 and so on may be counted.

The image reading unit 7 is arranged above the apparatus main body 8. The image reading unit 7 comprises a contact glass 62 on which an original document not shown in the diagram is placed, a pressing panel 63 freely separable from the contact glass 62, a scanning unit 64 for scanning and reading the image of the original document, a lens 65 for converging the scanned image, an image reading sensor 66 such as CCD or the like for processing the converged image, and a document size detection sensor group 67 comprising a plurality of document size detection sensors for detecting the size of the original document. The document size detection sensor group 67 is used to generically describe a plurality of sensors for detecting the size of the original document along the direction of conveyance thereof and a plurality of sensors for detecting the size of the original document in the width direction orthogonal to the direction of conveyance thereof.

An automatic document feeder (ADF) or automatic reversing document feeder (ARDF) not shown in the diagram employed for automatically reading a plurality of original documents are arranged, as appropriate, in a part above the pressing panel 63.

Figure 3:
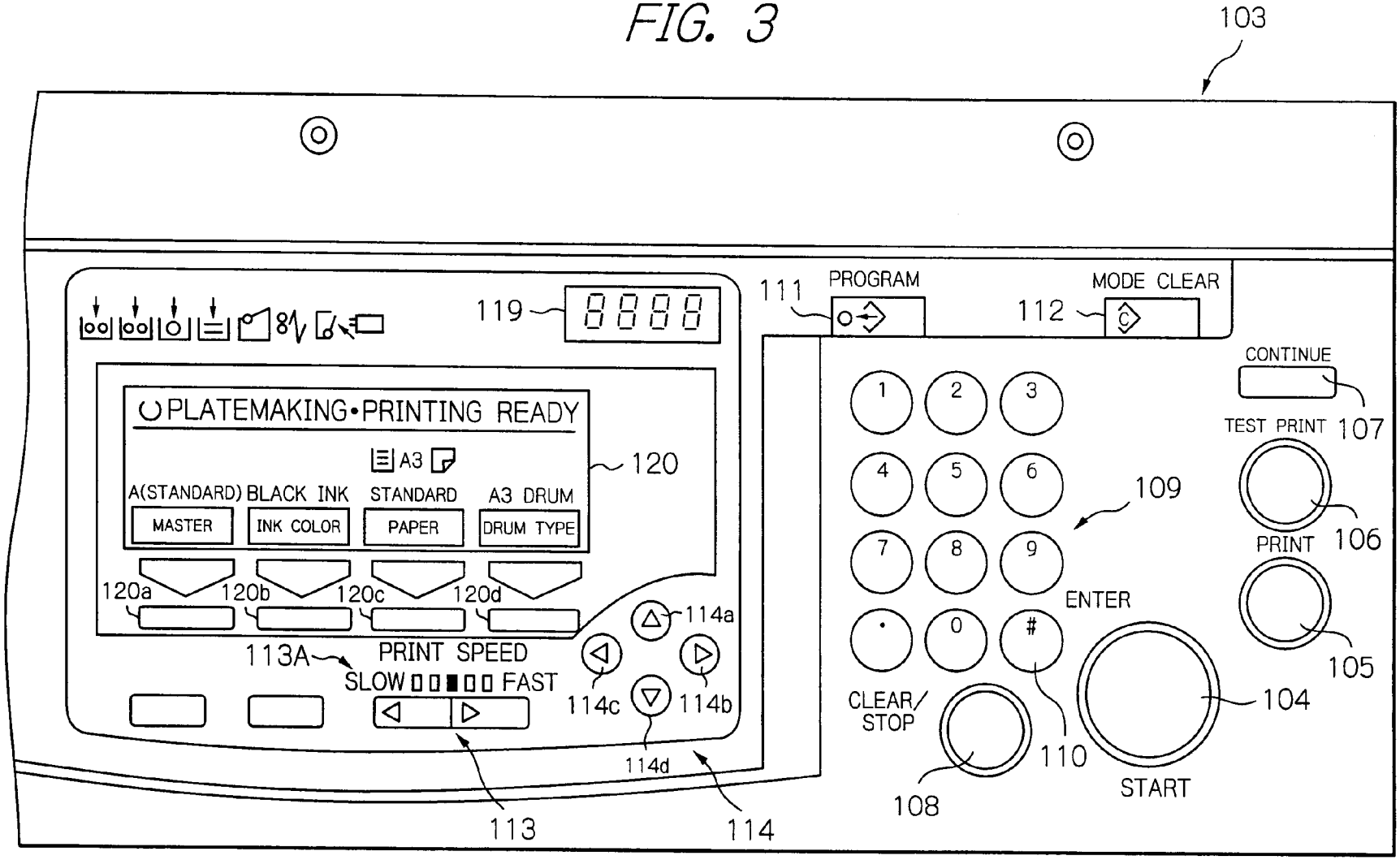
FIG. 3 is a plan view of a main part of an operating panel.

As shown in FIG. 3, an operating panel 103 for operating the stencil printing apparatus 1 is arranged in the front face of the upper part of the apparatus main body 8. As shown in the same drawing, a display device 119 configured from a platemaking start key 104, a print start key 105, a test printing start key 106, a continue key 107, a clear/stop key 108, a ten-key pad 109, an enter key 110, a program key 111, a mode clear key 112, a printing speed setting key 113, a speed indicator 113A, a 4-direction keypad 114, a 7-segment LED (light-emitting diode) and a display device 120 configured from an LCD (liquid display device) and so on are arranged in the operating panel 103.

The platemaking start key 104 is pressed when a platemaking operation by the stencil printing apparatus 1 is to be implemented and, when the platemaking start key 104 is pressed, the platemaking operation follows the implementation of a plate discharge operation and a document reading operation and is followed by a plate fixing operation which establishes the print standby state of the stencil printing apparatus 1. The print start key 105 is pressed when the printing operation by the stencil printing apparatus 1 is to be implemented, and the printing operation is implemented when, subsequent to the print standby state of the stencil printing apparatus 1 being established and various printing conditions being set, the print start key 105 is pressed. The test printing start key 106 is pressed when a test printing by the stencil printing apparatus 1 is to be implemented whereupon, subsequent to the various printing conditions being set and the test printing start key 106 being pressed, a single sheet only is printed. When the platemaking and printing operations are to be continuously implemented the continue key 107 is pressed prior to the platemaking start key 104 being pressed and, when the platemaking start key 104 is pressed subsequent to the continue key 107 being pressed and the printing conditions being input, a printing operation in which the plate discharge operation, original document read operation and platemaking operation are continuous is implemented.

The clear/stop key 108 is pressed either when the operation of the stencil printing apparatus 1 is to be stopped or when entries are to be cleared, and the ten-key pad 109 is employed for numerical input. The enter key 110 is pressed when numerical values and so on related to setting the various printing conditions are set, while the program key 111 is pressed in order to register a frequently implemented operation or to access an operation. The mode clear key 112 is pressed to clear the various modes and restore them to their initial state.

The printing speed setting key 113 is pressed ahead of the printing operation when the printing speed is set, and while the printing speed is slowed when there is a desire to produce a darker image or when the atmospheric temperature is low or the like, it is increased when there is a desire to produce a lighter image or when the atmospheric temperature is high and so on. Excluding the very-slow automatically set plate fixing printing speed (for example, of 15 to 20 sheets/min: 15 to 20 rpm), 5-stage: 1-speed to 5-speed printing speeds are settable by the printing speed setting key 113 with speed-down keys for setting slower printing speeds and speed-up keys for setting faster printing speeds being provided.

The "printing speed: 3-speed" displayed as a printing speed on the speed indicator 113A having a dark colored center part is the standard printing speed that corresponds to a normally used printing speed that is automatically set unless the aforementioned speed-down key or speed-up keys are pressed. For example, the leftmost side "printing speed: 1-speed" where the word "slow" is indicated corresponds to a minimum printing speed of 60 sheets/min: 60 rpm, the printing speed increases toward the right side in increments of 15 sheets/min: 15 rpm that corresponds to the printing speeds: 2-speed to 5-speed, and the rightmost side "printing speed: 5-speed" where the word "fast" is indicated corresponds to a maximum printing speed of 120 sheets/min: 120 rpm. Printing speed on the speed indicator 113A is switched in 5 stages from 1 to 5, and each time either the printing speed setting key 113*a* or the printing speed setting key 113*b* is pressed a flashing indication of the set printing speed appears thereon.

The 4-direction keypad 114 comprises an up key 114*a*, a down key 114*b*, a left key 114*c* and a right key 114*d* that are pressed when the image position is adjusted or when numerical values and items and so on are selected for the various settings. The left key 114*c* and right key 114*d* comprise a function as image position operation means and image position adjustment keys for indicating the amount a print image position is to be shifted in the paper conveyance direction, that is to say, for indicating a top-bottom shift amount.

More specifically, for example, each time the left key 114*c* is pressed the print image position can be shifted 0.25 mm to the downstream side in the paper conveyance direction, that is to say, in the direction of the top of the paper P while, conversely, each time the right key 114*d* is pressed the print image position can be moved 0.25 mm to the upstream side in the paper conveyance direction, that is to say, to the direction of the bottom of the paper P.

The display device 119, which is configured from a 7-segment LED, is principally used to display numbers including copy number and so on. The display device 120, which is configured from an LCD and which has a hierarchical display structure, is configured so that various printing conditions can be set and various modes including magnification change and image position adjustment and so on can be altered and these various modes set as a result of the selection setting keys 120*a*, 120*b*, 120*c* and 120*d* provided therebelow being pressed. In addition to the state of the stencil printing apparatus 1 such as, as shown in the diagram, "platemaking/printing ready", alarms indicating platemaking or plate discharge jam or paper supply or paper discharge jam along with supply commands for the supply of paper, master and ink and so are displayed in the display device 120.

The display device 120*a* comprises a function as master type setting means for setting master type (the type of master) and, as shown in FIG. 7, one of three master types, that is to say, A (standard) master, B (durable) master and C (cost-down) master can be selected. The selection setting key 120*a* has a known configuration that facilitates display and selection of the master type in the display device 120 in a monochrome reverse display whenever it is pressed, and the later-described selection setting keys 120*b*, 120*c* and 120*d* have an identical configuration.

The A (standard) master displayed in the display device 120 of FIG. 3 constitutes a predetermined master 23 used in this embodiment for which, for example, a 3-layer configuration of a total thickness no more than 50 μm comprising a polyester-based thermoplastic resin film of thickness 1.0 to 2.5 μm, a porous substrate of thickness 10 to 20 μm, and a paper fiber layer comprising the remaining thickness is employed. This master is proposed in Japanese Laid-Open Patent Publication No. H10-147075 and, for example, constitutes a master formed by provision of a porous resin film configured from a resin provided on one surface of a polyethylene terephthalate (PET)-based thermoplastic resin film, and a porous fiber film configured from a fibrous material laminated on the surface thereof.

The stretch characteristic (stretch rate) of the master 23 itself of the A (standard) master is dependent on the copy number and lies somewhere in between the stretch characteristics of the B (durable) and C (cost-down) masters.

The selection setting key 120*b* comprises a function as ink color setting means for setting ink color and, as shown in FIG. 7, one of six ink types, that is to say, a black ink, red ink, blue ink, green ink, dark-blue ink or purple ink can be set. The black ink indicated in the display device 120 of FIG. 3 constitutes the predetermined ink color used in this embodiment. The adhesion strength of an ink differs according to its fluidity which is dependent upon the composition of the pigments and so on and the amount thereof that it contains, that is to say, it differs according to ink viscosity which is dependent upon ink color type.

The selection setting key 120*c* comprises a function as paper type setting means for setting the paper type that serves as the recording medium and, as shown in FIG. 7, one of three paper types, that is to say, thin paper including recycled paper or Japanese silk paper, standard paper including high-quality stencil paper and normal paper, or thick paper including photo paper, postcards and envelopes can be selected. The standard paper indicated in the display device 120 of FIG. 3 constitutes the predetermined paper used in this embodiment. The thickness of a paper differs principally according to the type thereof and, accordingly, the size of the pressure in the tensile direction of the master 23 on the plate cylinder 9, in other words, the master position displacement on the plate cylinder 9, is affected thereby.

The selection setting key 120*d* comprises a function as plate cylinder type setting means for setting the plate cylinder type (hereinafter also referred to as "drum type") and, as shown in FIG. 7, one of three drum types, that is to say, an A3 drum, and A4 drum and a DLT drum (double-letter drum) can be set. The A3 drum indicated in the display device 120 of FIG. 3 constitutes the predetermined plate cylinder used in this embodiment. The length and surface area of the master wound around the plate cylinder differ principally according to the type thereof and, accordingly, master position displacement on the plate cylinder 9 is affected thereby.

Because of the limitations to the predetermined printing conditions in this embodiment as described later, the selection setting keys 120*a* to 120*d* are not essential to the configuration and need not be provided. In addition, a configuration in which the setting keys 120*a* to 120*d* are replaced by the provision of special-purpose keys and LED and so on, and in which the printing condition set state is confirmable by flashing LED and so on may be adopted.

Figure 2:
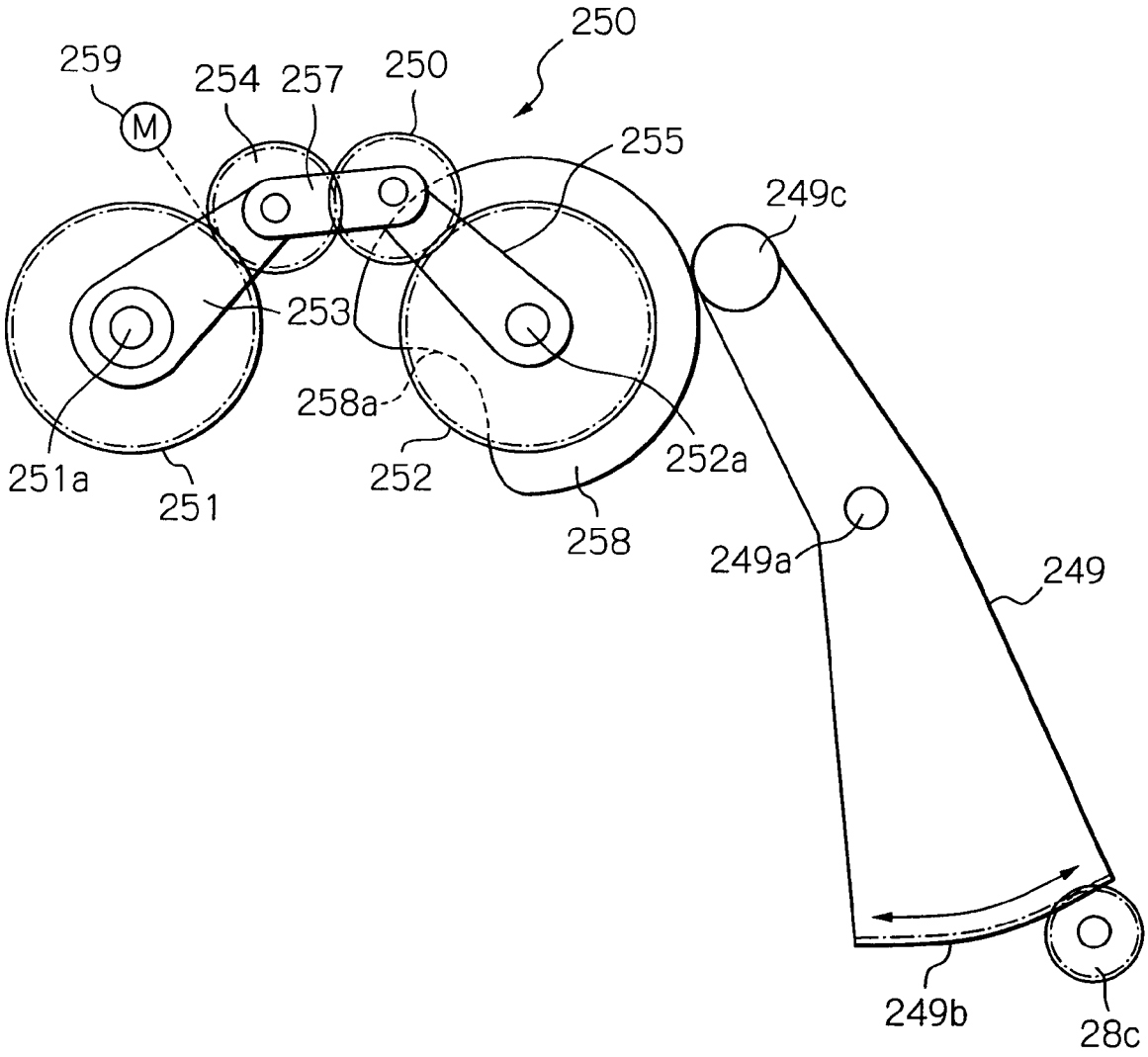

Referring to FIGS. 1 and 2, the periphery of top-bottom shift means 250 will be described.

A sector gear 249 for rotationally driving a drive roller 28*a* is arranged in the inner part of the apparatus main body 8. The sector gear 249, of which the essentially center portion thereof is supported with freedom to swing in the apparatus main body 8 by a supporting shaft 249*a*, comprises a gear part 249*b* and cam follower 249*c*. The gear part 249*b* engages with a resist gear 28*c* coaxially and integrally provided with the drive roller 28*a*.

A top-bottom shift means 250 for transmitting a rotational drive force from the main motor 45 to the sector gear 249 is arranged to the left of the sector gear 249. The configuration of top-bottom shift means 250 is the same as top-bottom shift means (50) disclosed in FIG. 3 of Japanese Laid-Open Patent Publication No. 2006-192835. That is to say, top-bottom shift means 250 comprises a drive gear 251, a driven gear 252, a first link 253, a first gear 254, a second link 255, a second gear 256, a third link 257, a resist cam 258 and phase displacement means not shown in the diagram and so on.

The drive gear 251, to which a rotational drive force from the main motor 45 is transmitted, is affixed to a supporting shaft 251*a* supported with freedom to rotate in the apparatus main body 8. The driven gear 252, which describes the same shape as the drive gear 251, is affixed to a supporting shaft 252*a* supported with freedom to rotate in the apparatus main body 8, and the resist cam 258 for swinging the sector gear 249 is integrally affixed to the supporting shaft 252*a*. The resist cam 258 comprises a recess 258*a* in one portion of its circumferential surface, a cam follower 249*c* rollable along the circumferential surface of the resist cam 258 being constantly pressingly contacted against this circumferential surface by an urging force of urging means not shown in the diagram (for example, a tension spring tensioned to a right-side part from a resist gear 28*c* of the sector gear 249 and so on). According to this configuration, when the resist cam 258 is rotated and the cam follower 249*c* fits into and engages with the recess 258*a*, the resist gear 28*c* is rotationally driven and the drive roller 28*a* is rotationally driven as a result of the sector gear 249 swinging in the anticlockwise direction in FIG. 2. Moreover, a one-directional clutch not shown in the diagram is interposed between shafts of the resist gear 28*c* and drive roller 28*a* to prevent the rotational force of the sector gear 249 when swinging in the clockwise direction from being transmitted to the drive roller 28*a*.

One end part of the first link 253 is supported with freedom to rotate in the supporting shaft 251*a*, the first gear 254 being supported with freedom to rotate in the other end of the first link 253 in a mode in which the circumferential surface thereof engages with the circumferential surface of the drive gear 251. As a result, the first gear 254 is rollably supported along the circumferential surface of the drive gear 251 by the first link 253.

One end part of the second link 255 is supported with freedom to rotate in the supporting shaft 252*a*, the second gear 256 being supported with freedom to rotate in the other end of the second link 255 in a mode in which the circumferential surface thereof engages with the circumferential surface of the driven gear 252. As a result, the second gear 256 is rollably supported along the circumferential surface of the driven gear 252 by the second link 255. Furthermore, the first gear 254 and second gear 256 are supported with freedom to rotate by the third link 257 in a state in which their circumferential surfaces are engaged.

Phase displacement means configured from an arm member not shown in the diagram extendable by means of an actuator not shown in the diagram such as a motor or cylinder is mounted in the first link 253. As shown simply in FIG. 2, a specific example of phase displacement means comprises a forward/reversible top-bottom shift motor 259 fixed to a side of the apparatus main body 8, a male screw not shown in the diagram fixed to an output shaft of the top-bottom shift motor 259, an arm member (not shown in the diagram) arranged in the first link 253 in which a female screw into which the aforementioned male screw is screwed is formed, and a home position sensor not shown in the diagram for detecting the home position of the arm member. As a result of the forward and reverse operation of the top-bottom shift motor 259 of phase displacement means not shown in the diagram in a state in which both the main motor 45 and drive gear 251 are stopped, the first gear 254 is rolled along the perimeter surface of the drive gear 251 by displacement of the position of the first link 253, the driven gear 252 is rotated by way of the second gear 256 accompanying the rotation of the first gear 254, the position of the recess 258*a* is displaced by rotation of the resist cam 258 accompanying the rotation of the driven gear 252, and the operating timing of the resist roller pair 28 (drive roller 28*a*) with respect to the phase (rotational angle) on the plate cylinder 9 is altered.

Moreover, while in this embodiment a configuration in which the operation timing of the resist roller pair 28 with respect to the phase of the plate cylinder 9 is altered as a result of the first link 253 being displaced by the top-bottom shift motor 259 of phase displacement means not shown in the diagram and first gear 254 being rolled on the drive gear 251 is adopted, a configuration in which the operation timing of the resist roller pair 28 with respect to the phase of the plate cylinder 9 is altered by displacement of the second link 255 by the top-bottom shift motor 259 of phase displacement means not shown in the diagram and the second gear 256 being rolled along the driven gear 252 may also be adopted. Top-bottom shift means 250 is not limited thereto, and top-bottom shift means (65) as disclosed in FIG. 5 of Japanese Laid-Open Patent Publication No. 2006-192835 may also be used.

In addition, if a system in which the resist roller pair 28 is rotational driven independently of the main motor 45 using a resist motor configured from, for example, a stepping motor and the timing at which initiation (startup) of the rotational drive of the resist motor is initiated (startup) occurs is altered is employed as top-bottom shift means, a continuous top-bottom shift can be executed during printing without need for the plate cylinder 9 to be stopped.

In addition, top-bottom shift means is not limited to a "resist roller system" in which the rotational start and operation timing of the resist roller pair 28 as feed means for feeding paper P to the printing unit 2 is altered in synchronization with the rotation on the plate cylinder 9 as described above and, for example, a top-bottom shift means in which the phase of the plate cylinder itself is changed as shown by the top-bottom shift means (145*a*) disclosed in, for example, FIG. 2 of Japanese Laid-Open Patent Publication No. H11-138961 may also be used. Furthermore, top-bottom shift means disclosed in, for example, Japanese Laid-Open Patent Publication No. H9-220850 may be employed in apparatuses that use an impression cylinder as pressing means. That is to say, while all known top-bottom shift means may be adopted for employment in the present invention, top-bottom shift means to be utilized for the printing apparatus including stencil printing apparatus are selected and adopted with consideration of the various merits and effects and so on thereof.

A photoencoder (not shown in the diagram) is mounted on an output shaft of the main motor 45 for rotationally driving the plate cylinder 9. Detection of printing speed is afforded by a printing speed sensor 47 serving as printing speed detection means shown in FIG. 4 configured from a transmission-type photosensor mounted in the apparatus main body 8 side about the photoencoder. Moreover, the aforementioned photoencoder may be mounted in an end panel of the plate cylinder 9 not shown in the diagram, and the printing speed sensor 47 mounted in the apparatus main body 8 side about the photoencoder.

In addition, as shown in FIG. 1, a light-shielding plate 49 is mounted in the outer surface of an end panel not shown in the diagram from which the plate cylinder 9 is configured. In addition, a home position sensor 48 configured from a transmission-type photosensor is selectively mounted about the light-shielding plate 49 in the apparatus main body 8 in the vicinity of the perimeter of plate cylinder 9. The home position sensor 48 detects the light-shielding plate 49 when the clamp 15 occupies a position opposing the press roller 10, and then outputs a signal to control means 75 shown in FIG. 4 expressing that the home position, or the initial position on the plate cylinder 9, is occupied.

Figure 4:
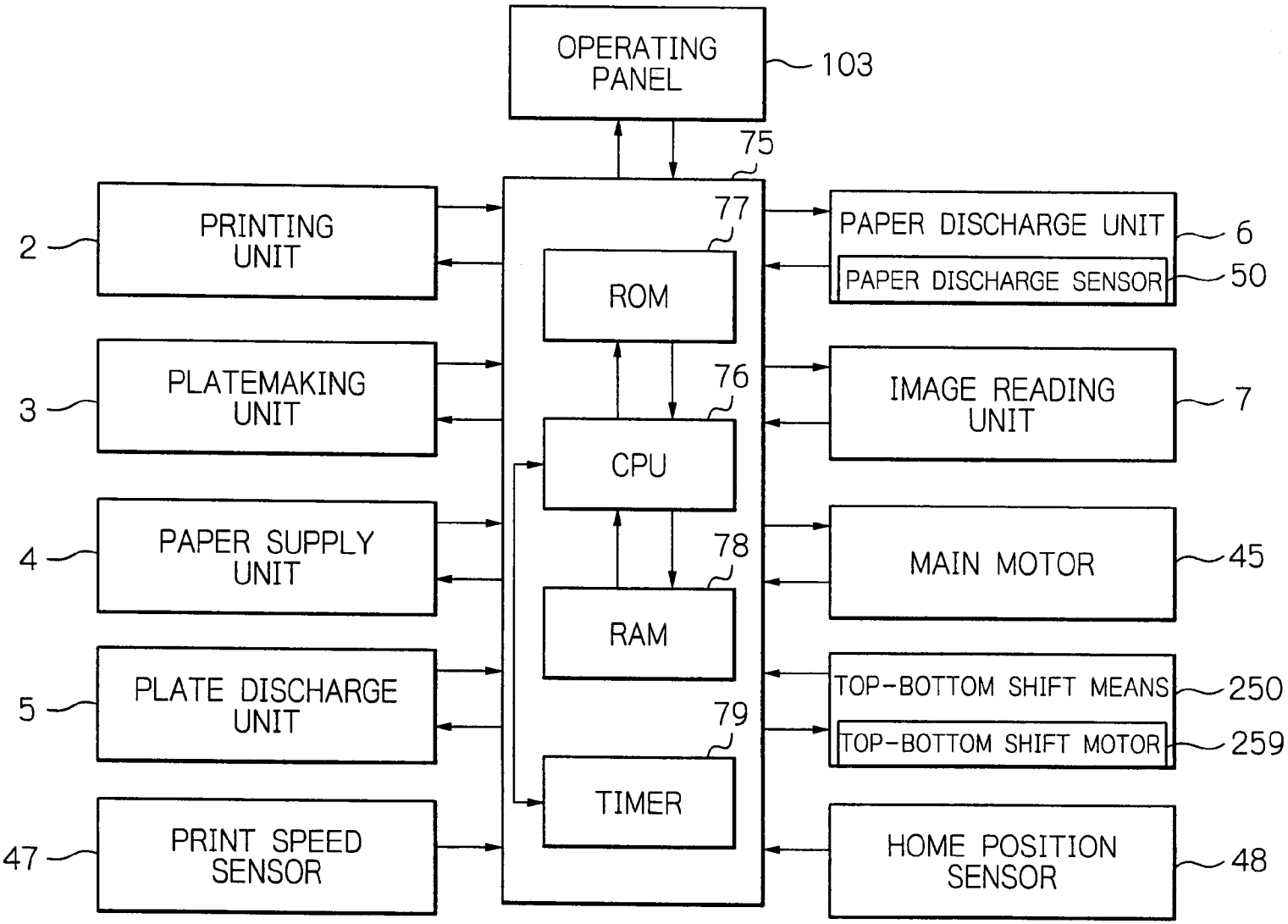
FIG. 4 is a block diagram of a control structure of the first embodiment.

Referring to FIG. 4, the control structure of the main part of the stencil printing apparatus 1 will be described.

In the drawing, control means 75 provided in the inner part of the apparatus main body 8 is configured from a microcomputer comprising a CPU 76, a ROM 77, a RAM 78 and a timer 79 and so on. Various operation signals (ON/OFF signals pertaining to startup and settings and data signals) are input by way of the operating panel 103 into control means 75. In addition, a signal pertaining to printing speed from the printing speed sensor 47, a signal pertaining to the initial position of the plate cylinder 9 from the home position sensor 48, a signal pertaining to copy number from the paper discharge sensor 50 of the paper discharge unit 6, and various signals from sensors and so on (not shown in the diagram) arranged in the printing unit 2, platemaking unit 3, paper supply unit 4, plate discharge unit 5, paper discharge unit 6 and image reading unit 7 are input into control means 75.

In accordance with various signals input as described above, control means 75 controls various drive means of the printing unit 2, the platemaking unit 3, the paper supply unit 4, the plate discharge unit 5, the paper discharge unit 6 and the image reading unit 7, as well as the main motor 45 and top-bottom shift motor 259 of top-bottom shift means 250.

In addition, control means 75 comprises a function for, in accordance with various input signals, controlling the operation of each of a speed indicator 113*a* of the operating panel 103 of which the illustration thereof has been omitted from FIG. 4, the display device 119 and the display device 120.

The various input signals described above, that is to say, the output signals from the operating panel 103, printing speed sensor 47, home position sensor 48 and plate discharge sensor 50 are input into the CPU 76. These input signals are processed in accordance with an operation program stored in the ROM 77, and are output respectively as operation command signals to the various drive circuits for controlling the operation of the printing unit 2, the platemaking unit 3, the paper supply unit 4, the plate discharge unit 5, the paper discharge unit 6, the image reading unit 7, the main motor 45 and the top-bottom shift motor 259 of top-bottom shift means 250, and output as a display signal to the operating panel 103.

Figure 5:
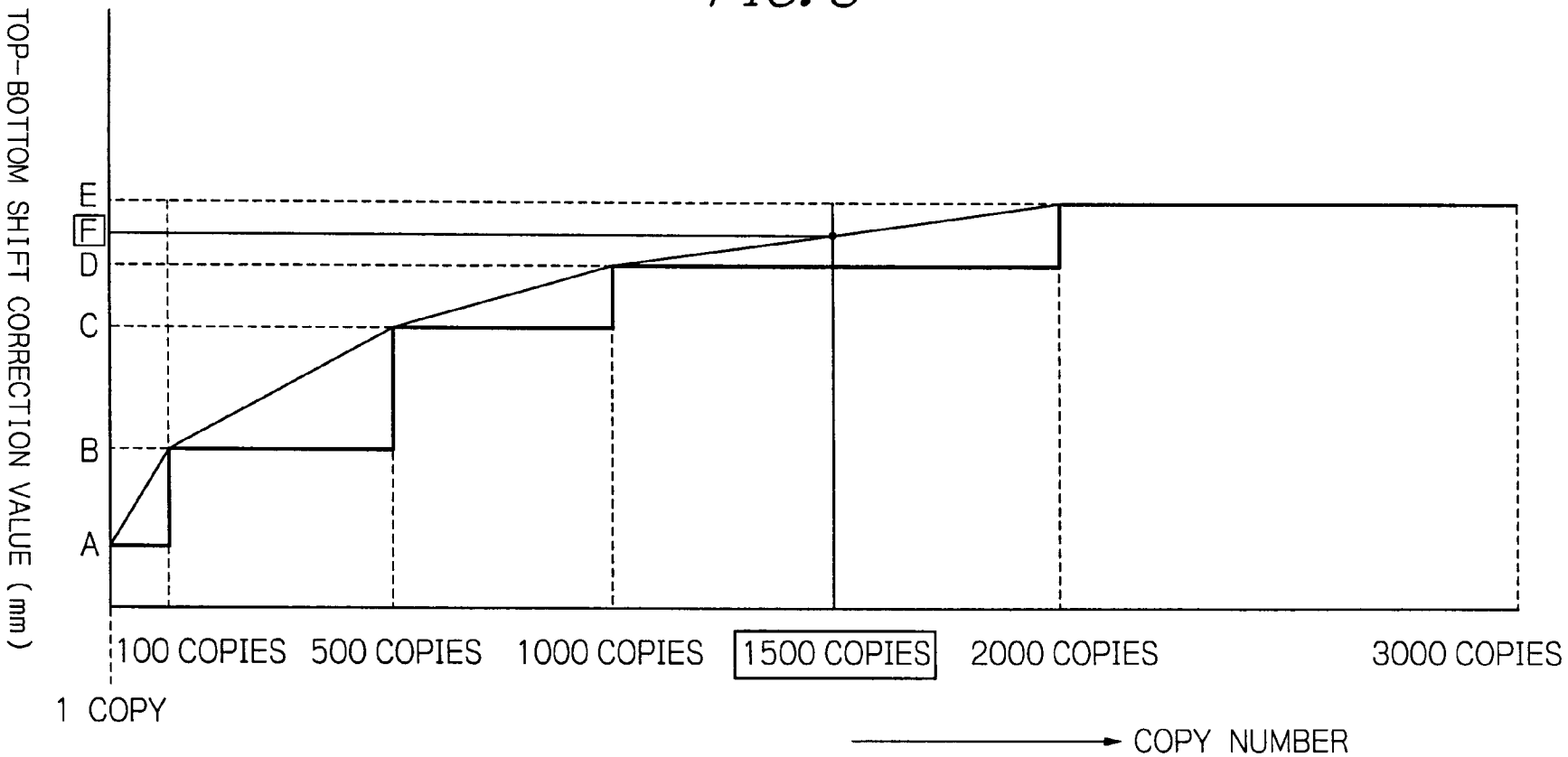
FIG. 5 is an explanatory diagram showing a data table of top-bottom shift correction values set for each predetermined copy number where the top-bottom shift correction values have been determined by calculation in accordance with specific copy numbers within a predetermined copy number range.

A plurality of operation programs for actuating an actuator such as a motor or solenoid or the like of each of the units of the stencil printing apparatus 1 described above are stored in the ROM 77. These operation programs include, as an operation program pertaining to top-bottom shift means 250, an operating program for the top-bottom shift motor 259 of phase displacement means not shown in the diagram, and operation programs for the data table of preset top-bottom shift correction values for each predetermined copy number as shown in FIG. 5 and for the main motor 45. The actuation of the top-bottom shift motor 259, which is implemented in accordance with a set amount in the paper conveyance direction (top to bottom direction) set by way of the operating panel 103, is automatically executed during printing. As is described above, ROM 77 comprises a function as storage means for storing preset top-bottom shift correction values for each predetermined copy number.

An operation program accessed from the ROM 77 by the CPU 76 is temporarily written in the RAM 78, and this operation program is rewritten by input received by way of the operating panel 103. The total copy number as arrived at by computation by the CPU 76 of the copy number sent from the paper discharge sensor 50 is stored in the RAM 78. The RAM 78 comprises a function for temporarily storing the signals sent from the various sensors described above and the CPU 76 and so on.

Here, the data table of the predetermined copy number and top-bottom shift correction values as shown in FIG. 5 will be described again with reference to FIGS. 20A and 20B. The effect of the present invention in terms of master stretch in terms of not only the initial-state stretch amount of the master 23 itself as described above but also the master stretch that accumulates as a result of the stretch of the printed master 23 on the plate cylinder 9 which gradually stretches as the copy number increases was confirmed. The master position displacement and so on caused mainly by clamping the printed master 23 on the plate cylinder 9 and correction thereof of this embodiment will be hereinafter described.

As described in the section pertaining to problems above and, as is the case for the stencil printing apparatus 1 of this embodiment as shown in FIG. 20A, in the printed master 23 of which the leading-edge portion thereof is clamped and held by the clamp 15 provided in the plate cylinder 9, apart from the minor initial-state deflection amount 51 that is evident when the master is wrapped, as a result of the master 23 being pulled in the direction of rotation on the plate cylinder 9 when printing pressure is applied during printing by the press roller 10 not driven by independent drive means, unavoidable master position displacement which in turn results in printing position displacement is generated until the initial-state stretch amount of the master 23 itself and the initial-state deflection amount 51 is absorbed.

Because the position in which the initial-state deflection amount 51 of the printed master 23 is generated is a non-aperture portion in the perimeter of the plate cylinder 9 in which the clamp 15 is arranged, a state in which the printed master 23 of the initial-state deflection amount 51 is precluded from being adhered to the outer circumferential surface of the plate cylinder 9 by the ink occurs.

A state in which, as shown in FIG. 20B, both the initial-state deflection amount 51 and the initial-state stretch amount of the master 23 itself is absorbed constitutes a state in which, excluding a trailing-edge portion 53 of the printed master 23, the printed master 23 of the upstream side in the direction of rotation on the plate cylinder 9 from the initial-state deflection amount 51 is adhered to the outer circumferential surface of the plate cylinder 9 by the adhesive force of the ink exuded through the aperture portion of the plate cylinder 9.

It was learned through a number of tests carried out under the same printing conditions that a close correlative relationship exists between copy number and the master position displacement generated in the period until the initial-state deflection amount 51 and the initial-state stretch amount of the master 23 itself is absorbed. In addition, it was learned through a number of tests carried out that a correlative relationship exists between master position slip and copy number even when the printing conditions such as the master type and paper type and so on are changed.

Thereupon, in this embodiment, based on the relationship between copy number and master position displacement determined through testing, a data table expressing the relationship between predetermined copy number shown on the horizontal axis (1 copy, 101 copies, 501 copies, 1001 copies, 2001 copies . . . ) and top-bottom shift correction value (mm) shown on the vertical axis of FIG. 5 was set, and this was prestored in a program for the ROM 77. The maximum amount of top-bottom shift correction value (mm) was set to the order of roughly 5 mm in the stencil printing apparatus 1 of, for example, the configuration described above.

While copy number (main parameter) is taken as the master position displacement correction parameter in this embodiment of the printing conditions which affect master displacement position, as outlined in the later-described modifications, various other sub-parameters may be used. Accordingly, predetermined types or predetermined values of master type, drum type, ink color, printing speed, and paper type and ink temperature may be set as sub-parameters in the data table employed in this embodiment. From a different viewpoint, this embodiment may be regarded as an embodiment that focuses on the use of copy number alone as the main parameter that does not consider sub-parameters.

While a data table expressing the relationship between the copy number and the top-bottom shift correction values shown in FIG. 5 will produce the trend as shown in this diagram using the printing unit 2 of the configuration of the first embodiment, this represents an example only, and the peculiar trends produced mainly by the constituent particulars of a printing unit of a printing apparatus including a stencil printing apparatus may be illustrated therein, and it may be noted that the present invention is able to have application in printing apparatuses such as this.

The operation of the stencil printing apparatus 1 based on the configuration described above will be hereinafter described.

While the operation of the stencil printing apparatus 1 is administered principally under a control function of the CPU 76 of control means 75, for reasons of simplification of the description, the CPU 76 of control means 75 is hereinafter sometimes referred to simply as control means 75.

The original document to be printed is placed on the contact glass 62 by the user after which, when the platemaking start key 104 is pressed with the pressing panel 63 in a closed state, a read operation of the original document image is performed by the image reading unit 7. This image reading involves scanning of the original document image by the scanning unit 64, the read image being converged by the lens 65 and then sent to the image reading sensor 66.

In parallel with this image reading operation, a plate discharge operation in which the printed master 23 is peeled from the outer circumferential surface of the plate cylinder 9 by the plate discharge unit 5 and discharged is implemented. When the platemaking start key 104 is pressed, the main motor 45 is actuated to start the plate cylinder 9 rotating whereupon, when the plate cylinder 9 reaches a predetermined plate discharge position, it stops rotated. Thereafter, the lower plate discharge member 32 is actuated and shifted to the peeling position, whereupon the printed master 23 on the plate cylinder 9 is scooped up by the lower plate discharge member 32. Following this, the plate cylinder 9 is rotationally driven and the upper plate discharge member 31 is actuated, whereupon the printed master 23 on the plate cylinder 9 is conveyed by the plate discharge members 31, 32 and housed in the plate discharge box 33. Next, the compression plate 34 is actuated to compress the used master 23 in the plate discharge box 33, and the plate cylinder 9 is rotated to a predetermined plate supply position, that is to say, until the clamp 15 is in the position at roughly the right side of FIG. 1, and then stopped, whereupon the clamp 15 is released and the plate supply standby state of the stencil printing apparatus 1 is established.

In parallel with the plate discharge operation, a platemaking operation is implemented by the platemaking unit 3. As a result of a stepping motor not shown in the diagram being rotationally driven when the platemaking start key 104 is pressed, each of the platen roller 17, master conveyance roller pair 20 and reverse roller pair 21 are rotated, whereupon the master 23 is drawn from the master roller 23*a*. The drawn master 23 is thermally perforated as it is passed by the thermal head 18, whereupon a platemaking image is formed on the thermoplastic resin film thereof. At this time, the aforementioned master guide panel (not shown in the diagram) occupies the first guide position, whereupon the master 23 fed by the master conveyance roller pair 20 is guided to the reverse roller pair 21. When the leading edge of the master 23 is nipped by the reverse roller pair 21, the aforementioned master guide panel is switched to the second guide position and the master 23 fed by the master conveyance roller pair 20 is stored in the flexile box 22*a* of master stock means 22.

When the plate supply standby state of the stencil printing apparatus 1 is established, the reverse roller pair 21 is rotated to cause the printed master 23 to be fed toward the clamp 15. When control means 75 determines from the step number of the stepping motor not shown in the drawing that the leading edge of the master 23 has been conveyed to a position holdable by the clamp 15, the clamp 15 closes and the leading-edge portion of the printed master 23 is held on the outer circumferential surface of the plate cylinder 9.

Following this, the plate cylinder 9 is rotated at a peripheral speed roughly the same as the conveyance speed of the master 23, whereupon the wrapping operation of the master 23 on the plate cylinder 9 is implemented. Subsequently, when control means 75 determines that a 1 plate-segment master 23 has been made, the actuation of the platen roller 17 and master conveyance roller pair 20 is stopped, and master cutting means 19 is actuated to cut the master 23. The cut master 23 is delivered from the platemaking unit 3 as a result of the rotation of the plate cylinder 9 and the reverse roller pair 21 to complete the platemaking and plate supply whereupon, subsequent to the master 23 being wrapped, the plate cylinder 9 is rotated to the home position and stopped.

A plate fixing operation is implemented continuous with the plate discharge operation. When the plate cylinder 9 is stopped at the home position, the plate supply roller 25 and separating roller 26 are rotated to draw the uppermost paper P from the plate supply tray 24, and the plate cylinder 9 is rotationally driven at a low speed in the clockwise direction of FIG. 1. The drawn paper P is individually supplied in single sheets, the leading edge thereof being caused to collide with and abut a nip portion of the resist roller pair 28 (the paper in this state is referred to as paper PA). At a predetermined timing at which the leading-edge portion of the image region of the master 23 wrapped around the plate cylinder 9 in the direction of rotation of the plate cylinder arrives at a contact part with the press roller 10, the cam follower 249*c* shown in FIG. 2 fits into and engages with the recess 258*a* and, as a result of the sector gear 249 being swung in the anti-clockwise direction in FIG. 2 about the supporting shaft 249*a* and the drive roller 28*a* (resist roller pair 28) being rotationally driven by the rotational drive of the resist gear 28*c*, the paper P is fed toward the contact part between the plate cylinder 9 and press roller 10. As a result of actuation of swinging means not shown in the drawing essentially simultaneously with the resist roller pair 28, the circumferential surface of press roller 10 is pressingly contacted against the outer circumferential surface of the plate cylinder 9, whereupon the supplied paper P is pressingly contacted against the master 23 on the plate cylinder 9. As a result of this pressing operation, the press roller 10, paper P, master 23 and plate cylinder 9 are pressingly contacted, the ink supplied to the inner circumferential surface of the plate cylinder 9 by the ink roller 12 is exuded through the aperture portion on the plate cylinder 9, packed into the porous substrate of the master 23, and transferred to the paper P by way of the perforated portion, whereupon the so-called plate fixing operation is implemented.

The paper P onto which the image has been transferred by this plate fixing is peeled from the outer circumferential surface of the plate cylinder 9 by the peeling hook 35, lowered downward to be fed to the paper discharge adsorption conveyance device 36, and then suction conveyed further downstream side in the direction of paper conveyance Xb by the paper discharge adsorption conveyance device 36 (the printed paper in this state is referred to as the discharge paper PB). With the two side edges of the discharge paper PB being aligned by the side fences 41 and, in addition, the leading edge of the discharge paper PB colliding width the end fences 42 and the collision energy thereby being absorbed thereby, the discharge paper PB is discharged in an orderly way to the paper discharge tray 43. Subsequently, the plate cylinder 9 is rotated to the home position again and stopped to complete the plate fixing operation and to establish the print standby state of the stencil printing apparatus 1.

Subsequent to the print standby state of the stencil printing apparatus 1 being established, when printing conditions are input by the various keys of the operating panel 103 and then the test printing start key 106 is pressed, the plate cylinder 9 is rotated at a peripheral speed in accordance with the set printing speed which is a higher speed that the plate fixing speed, a single sheet of paper P is supplied from the paper supply unit 4, and a test printing the same as that performed during plate fixing is implemented. Image position and image density and so on are confirmed by the test printing and, when the print start key 105 is pressed subsequent to the copy number being set by the ten-key pad 109 of the operating panel 103, the paper P is continuously supplied from the paper supply unit 4 and the print operation the same that carried out for the test printing is implemented. When the set copy number is deleted, the plate cylinder 9 stops at the home position and the printing standby state of the stencil printing apparatus 1 is again established.

In this embodiment, a signal pertaining to copy number of the paper P used for the plate fixing and test printing counted by the paper discharge sensor 50 during plate fixing and test printing is invalidated by the CPU 76 of control means 75 so that, in the same way as the prior art, it is not counted in the normal copy number.

The copy number for printing includes the later-described "plate change" which, when cleared for the plate making of a new master is not cleared by the next plate making and is instead added to each printing and stored in the RAM 78. Accurate correction of printing position displacement is afforded by the addition thereof at times of supplementary printing and test printing. Naturally, when a printed master in which a platemaking image the same as another printed master is formed is wrapped (plate change) around the plate cylinder 9, the copy number is cleared at the time of printing (hereinafter this is the same for modifications of the first embodiment).

Printed image position adjustment when there is a wish to displace the printed image position formed on the paper P in the paper conveyance direction Xa in the test printing described above is performed by way of the operating panel 103. This printed image position adjustment is implemented using the left key 114*c* and right key 114*d* and, taking the existing position (non-adjusted position) as 0, the left key 114*c* is employed to effect shift to the downstream side in the direction of paper conveyance Xa and the right key 114*d* is employed to effect shift to the upstream side in the direction of paper conveyance Xa, the adjustment amounts displayed in the display device 120 being input in 0.25 mm units.

When, subsequent to input of the shift amount, the printing start key of the operating panel 103 is pressed, the top-bottom shift motor 259 of phase displacement means not shown in the diagram for top-bottom shift means 250 is actuated whereupon, as is described above, the operation timing of the resist roller pair 28 with respect to the phase of the plate cylinder 9 is altered and the printed image position is adjusted in response to the set shift amount.

During normal printing executed by, following plate fixing and then test printing as appropriate, the copy number being set using the ten-key pad 109 of the operating panel 103 as described above and then the print start key 105 being pressed, the CPU 76, each time the copy number counted by the paper discharge sensor 50 reaches a predetermined copy number as shown in FIG. 5 (1 copy, 101 copies, 501 copies, 1001 copies, 2001 copies . . . ) reads from the ROM 77 the top-bottom shift correction value corresponding to the aforementioned predetermined copy number, that is to say, a top-bottom shift correction value Amm set corresponding to the copy number 1 copy to 100 copies following start of normal printing, a top-bottom shift correction value Bmm set corresponding to a copy number 101 copies to 500 copies, a top-bottom shift correction value Cmm set corresponding to a copy number 501 copies to 1000 copies, a top-bottom shift correction value Dmm set corresponding to the copy number 1001 copies to 2000 copies, and a top-bottom shift correction value Emm set corresponding to the copy number 2001 copies to 3000 copies, and controls the top-bottom shift motor 259 of top-bottom shift means 250 so as to execute a top-bottom shift correction in accordance with the read top-bottom shift correction values.

In a more detailed explanation of the operation particulars at this time using the copy number 101 as an example, first, the CPU 76, in accordance with a signal pertaining to a copy number 101 copies from the paper discharge sensor 50 and a signal from the home position sensor 48, controls the main motor 45 to stop the plate cylinder 9 at the home position. Next, in order that the master position displacement of the printed master 23 in which position displacement in the upstream side in the direction of rotation on the plate cylinder 9 (phase delay side on the plate cylinder 9) corresponding to an amount equivalent to the initial-state deflection amount 51 and initial-state stretch amount of the master 23 itself as shown in FIG. 20A absorbed by the plate fixing and 101 copy normal printing operations as described above has occurred is corrected, the top-bottom shift motor 259 of top-bottom shift means 250 is actuated in such a way that that the feed timing of the drive roller 28*a* (resist roller pair 28) with respect to the phase of the plate cylinder 9 is deleted by an amount corresponding to the top-bottom shift correction value B.

To put this another way, if the top-bottom shift correction described above is not performed and printing is continued in accordance with a printed master 23 in which the trailing-edge position of the printed master 23 is displaced in the upstream side in the direction of rotation on the plate cylinder 9, that is to say, in which position displacement has occurred in the upstream side in the direction of rotation on the plate cylinder 9, because the printed image position will be displaced to the upstream side (bottom direction) in the direction of paper conveyance from a reference position in the paper conveyance direction by the amount of the top-bottom shift correction value B, the feed timing of the resist roller pair 28 is delayed by an amount corresponding to the top-bottom shift correction value B for correction the printing position displacement whereupon, as a result, the printed image position on the paper in the direction of paper conveyance is corrected to and maintained at the original standard position and.

Moreover, as specific numerical examples of the top-bottom shift corrections shown in FIG. 5 of this embodiment, a top-bottom shift correction value A: 0.25, top-bottom shift correction value B: 0.50, top-bottom shift correction value C: 1.00, top-bottom shift correction value D: 1.25 and top-bottom shift correction value E: 1.50 (mm) for which the aforementioned predetermined printing conditions correspond to a later-described selection pattern N shown in FIG. 9 are set.

As is described above, the printing method used in this first embodiment and which is used by the stencil printing apparatus 1 comprising a plate cylinder 9 around which a master 23 is wrapped and top-bottom shift means 250 for shifting the position of the printed image directly transferred onto the paper P from the master 23 on the plate cylinder 9 is in the direction of paper conveyance Xa can be described as a printing method in which a top-bottom shift correction value is preset in accordance with master position displacement correction parameters including copy number which affect the master position displacement of a printed master in the rotational direction of the plate cylinder 9, and in which in accordance with the top-bottom shift correction value thereof, a top-bottom shift correction is automatically executed by top-bottom shift means 250 during printing.

According to this first embodiment, as is described above, because each time the copy number counted by the paper discharge sensor so reaches a predetermined copy number the CPU 76 of control means 75 reads a top-bottom shift correction value corresponding to the predetermined copy number from the ROM 77 and controls the top-bottom shift motor 259 of top-bottom shift means 250 in such a way that a top-bottom shift correction is executed in accordance with the read top-bottom shift correction value, even if master position displacement occurs in response to copy number, printing position displacement can be prevented from occurring to ensure a printed material free of printing position displacement is produced, waste of master and paper can be eliminated and, in addition, the operation time can be shortened and the number of operation steps reduced.

Moreover, because the feed timing of the resist roller pair 28 of top-bottom shift means for altering the phase (rotating angle) itself on the plate cylinder 9 is fixed, drive means of top-bottom shift correction means is controlled in such a way that the phase (rotating angle) of the plate cylinder 9 is advanced by an amount corresponding to the top-bottom shift correction value B so that the printed image position on the paper in the direction of paper conveyance is corrected to and maintained at an original standard position.

Modification 1 of First Embodiment

Referring to FIG. 5, a modification 1 of the first embodiment will be described.

Modification 1 differs from the first embodiment, differs only in that control means 75, in addition to the calculation and control functions of the first embodiment, is provided with the following calculation function. Apart from this point of difference, this modification is identical to the first embodiment.

That is to say, in addition to the calculation and control functions of the first embodiment, in accordance with a signal pertaining to a predetermined copy number from the paper discharge sensor 50 in which copy number is counted as a copy number for each individual sheet in a predetermined copy number range stored in the ROM 77, control means 75 computes a top-bottom shift correction value for a predetermined copy number corresponding to a copy number for each individual sheet by performing a calculation based on a top-bottom shift correction value corresponding to a predetermined number and a top-bottom shift correction value corresponding to a next predetermined copy number from the ROM 77, and controls the top-bottom shift motor 259 of top-bottom shift means 250 to execute a top-bottom shift correction in accordance with the calculated top-bottom shift correction value.

While in this first embodiment a top-bottom shift correction value (hereinafter also referred to simply as "correction value") set for a predetermined copy number range is used when a top-bottom shift correction is executed during printing in accordance with copy number, this correction value in accordance with copy number does not possess individual sheet data and, accordingly, the correction is instead implemented in steps. In other words, because as the normal copy numbers (hereinafter referred to also simple as "copy number") of FIG. 5 a correction value A for between 1 copy and 100 copies, a correction value B for between 101 copies and 500 copies, a correction value C for between 501 copies and 1000 copies, a correction value D for between 1001 copies and 2000 copies and a correction value E for between 2001 copies and 3000 copies is established, the same correction value is produced for groups of a predetermined copy number range.

Thereupon, even though in this modification top-bottom shift correction values in accordance with copy number as described above are assigned to groups of each predetermined copy number range, the top-bottom shift correction values are determined by computation in accordance with individual sheet copy numbers. For example, when control means 75 is functionized to execute a top-bottom shift correction in accordance with, for example, a copy number of 1500 copies, a top-bottom shift correction value F equivalent to a predetermined copy number of 1500 copies is computed by a calculation performed employing a mathematical interpolation method on the correction value D assigned to the group of predetermined copy number range 1001 to 2000 copies and the correction value E assigned to the group of predetermined copy number range 2001 to 3000 copies in which there is deemed to be proportionality between top-bottom shift correction values and correspondent individual sheet copy numbers thereof, and top-bottom shift correction is executed in accordance with the computed top-bottom shift correction value.

Functionizing control means 75 to execute a more detailed top-bottom shift correction can be achieved by the adoption of a configuration based on the additional provision of a programmable PROM, for example, the additional provision of special-purpose keys in the operating panel 103 or employing a combination of various keys (ten-key pad 109, program key 111, enter key 110, selection setting keys 120*a*, 120*b*, 120*c*, 120*d* and so on) as appropriate, or by ROM chip replacement or the like.

Accordingly, using modification 1, a more detailed top-bottom shift correction corresponding to individual sheet predetermined copy number of a predetermined copy number range than with the first embodiment can be implemented.

Modification 2 of First Embodiment

As outlined in the description of the first embodiment, it was learned through a number of tests carried out under the same printing conditions that a close correlative relationship exists between copy number and the master position displacement generated in the period until the initial-state deflection amount 51 and the initial-state stretch amount of the master 23 itself is absorbed. However, it was confirmed through testing that, in reality, each time the master type or paper type or similar being used is changed, the top-bottom shift correction value set on the basis of the relationship between copy number and master position displacement changes.

Thereupon, by focusing on six printing conditions (master position displacement correction sub-parameters) in addition to the copy number (principal parameter of master position displacement correction) serving as a printing condition having a close correlative relationship with master position displacement, it is an object of this modification to automatically execute a top-bottom shift correction based on obtained top-bottom shift correction values that more closely approximates the printing conditions and environment of an actual apparatus.

Referring to FIGS. 6 to 9, the modification 2 of the first embodiment will be described.

Figure 6:
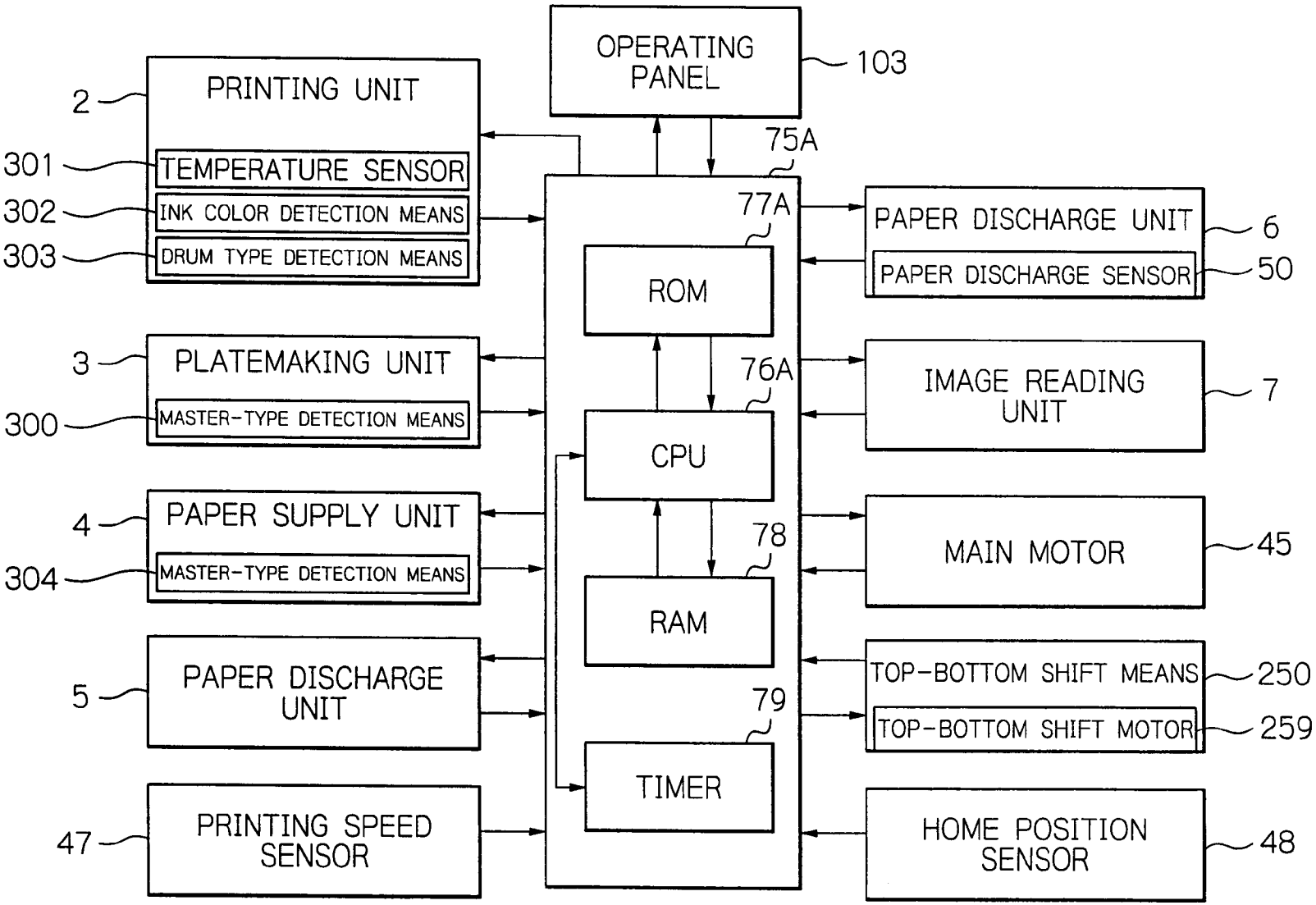
FIG. 6 is a block diagram of a control structure of a modification 2.

Modification 2 differs principally from the first embodiment in the employment of control means 75A shown in FIG. 6 instead of control means 75, and the employment in addition to copy number serving as the principal parameter of master position displacement correction affecting master position displacement of top-bottom shift correction values (FIG. 9) adjusted and set as patters (see FIG. 8) of six sub-parameters shown as the printing conditions (or selection conditions) in FIG. 7, that is, the sub-parameters of ink color, drum type, printing speed, paper type, ink temperature and master type. Apart from these points of difference, this modification is identical to the first embodiment. The aforementioned six sub-parameters noted above will be hereinafter described in order.

While for reasons of simplification of the description of this modification top-bottom shift correction values determined by pretesting and set in accordance with selection patterns combining all of the aforementioned six sub-parameters is employed, this is of course not limited thereto, and top-bottom shift correction may be implemented employing top-bottom shift correction values determined though pretesting and set in accordance with copy number for selection patterns that combine at least one of the aforementioned six sub-parameters.

In the stencil printing apparatus 1 of this modification in which multi-color superposed test printing of the aforementioned six ink color types is possible, ink color switchover can be easily implemented by drum unit replacement of a correspondent ink color. Any of the six ink types or ink color black ink, red ink, blue ink, green ink, dark blue ink and purple ink as shown in FIG. 7 are settable by the selection setting key 120*b* of the aforementioned operating panel 103 and detectable by a later-described color detection means.

Change in adhesion strength of ink due to its viscosity is an ink color-dependent characteristic that affects master position displacement. That is to say, focusing on the fact that, normally, the larger the ink viscosity and larger the adhesion strength of an ink color the smaller the relative master position displacement amount and, conversely, the smaller the ink viscosity and smaller the adhesion strength of an ink color the larger the relative master position displacement amount, the relationship between copy number and master position displacement amount was determined through testing for each ink color and used to conclusively determine top-bottom shift correction values reflecting the adjustment values thereof.

Ink color detection means 302 for detecting ink color is arranged in the printing unit 2 shown in FIG. 6. A specific example of ink color detection means 302 is ink-type detection means (135) comprising magnets (130, 131, 132) in the drum unit side and hole element sensors (136, 137, 138) arranged in the apparatus main body side as disclosed in FIG. 16 of Japanese Laid-Open Patent Publication No. 2004-155170.

The provision of both the selection setting key 120*b* and ink color detection means 302 is unnecessary, and either may be provided. High-grade types of apparatus that comprise both may describe a configuration in which, for example, the output signal from the selection setting key 120*b* set manually is validated and the output signal from ink color detection means 302 is invalidated. This is the same as later-described various parameter (printing condition) setting means and detection means. Incidentally, both the printing speed setting key 113 and printing speed sensor 47 are necessary.

In the stencil printing apparatus 1 of this modification, the drum units corresponding to the drum types of the aforementioned three types can be easily replaced. In this configuration, any of either the A3 drum, A4 drum and DLT drum as the drum types shown in FIG. 7 are settable by the selection setting key 120*d* of the operating panel 103 and detectable by later-described drum-type detection means.

Change in length and aperture surface area of a wound master is a drum type-dependent characteristic that affects master position displacement. That is to say, focusing on the fact that, normally, there is less relative master position displacement amount in an A4 drum in which the relative length and aperture surface area of the wound master is smaller and, conversely, there is more relative master position displacement amount in an A3 or DLT drum in which the relative length and aperture surface area of the wound master is larger, the relationship between copy number and master position displacement amount was determined through testing for each drum type and used to conclusively determine top-bottom shift correction values reflecting the adjustment values thereof.

Drum-type detection means 303 for detecting drum type is arranged in the printing unit 2 shown in FIG. 6. A specific example of drum-type detection means 303 is a configuration in which electrical detection based on difference in connection elements between a female electrical connector arranged in the apparatus main body side and a male electrical connector arranged in the drum unit side is possible. This is not limited thereto, and applications of detection means of a configuration the same as ink color detection means 302 is also possible.

A slower printing speed affects master position displacement. That is to say, there is a tendency when the printing speed is comparatively slow for it to take longer for the paper P to be pressed against the master 23 on the plate cylinder 9 and, as a result, for the master position displacement amount to increase and, when the printing speed is comparatively fast, for the time taken for this pressing to be shorter and, as a result, for the master position displacement amount to reduce. Focusing thereon, the relationship between copy number and master position displacement amount for each printing speed was determined through testing and used to conclusively determine top-bottom shift correction values reflecting the adjustment values thereof.

In this configuration, any of the thin paper, standard paper or thick paper shown in FIG. 7 can be set as paper types by the selection setting key 120*c* of the operating panel 103 and detected by a later-described paper type detection means.

Paper thickness is paper-type dependent and constitutes a principal characteristic affecting master position displacement. That is to say, while the contact pressure in the tensile direction on the master 23 on the plate cylinder 9 is relatively larger for thick paper and, as a result, the master position displacement amount is increased, the contact pressure in the tensile direction on the master 23 on the plate cylinder 9 is relatively smaller for thin paper and, as a result, the master position displacement amount is reduced. Focusing thereon, the relationship between copy number and master position displacement amount for each paper type was determined through testing and used to conclusively determine top-bottom shift correction values reflecting the adjustment values thereof.

Paper-type detection means 304 for detecting paper type is arranged in the paper supply unit 4 shown in FIG. 6. As a specific example of paper-type detection means 304, a known detection means for detecting paper thickness or measuring the thickness of the paper itself based on a quantity of transmitted light may be employed.

A higher ink temperature affects master position displacement. That is to say, normally, while the higher the ink temperature the lower the ink viscosity and the less the adhesion strength thereof and, accordingly, the more the relative master position displacement amount, conversely, the lower the ink temperature the higher the ink viscosity and the greater the adhesion strength thereof and, accordingly, the less the relative master position displacement amount. Focusing thereon, the relationship between copy number and master position displacement amount for each ink temperature was determined through testing and used to conclusively determine top-bottom shift correction values reflecting the adjustment values thereof. The ink temperature range was set in 3 stages, that is, low temperature: 18° C. or less ((0) to 18° C.), normal temperature: 19 to 29° C., and high temperature: 30° C. or above (30 to (40)° C.).

In this configuration any of the A (standard) maser, B (durable) master and C (cost-down) master which are shown in FIG. 7 can be set as master type by the selection setting key 120*a* of the operating panel 103 and detected by a later-described master-type detection means.

Master type affects master position displacement due to difference in the degree of stretch (stretch rate) of the master itself. Focusing on the fact that the degree of stretch (stretch rate) of the master itself is more likely in the master types in the order of B (durable), A (standard) and C (cost-down), the relationship between copy number and master position displacement amount for each master type was determined through testing and used to conclusively determine top-bottom shift correction values reflecting the adjustment values thereof.

Master-type detection means 300 for detecting master type is arranged in the platemaking unit 3 shown in FIG. 6. Maser type detection means (141) shown in FIG. 17 of Japanese Laid-Open Patent Publication 2004-155170 is a specific example of master-type detection means 300. That is to say, master-type detection means 300, which detects the type of master 23 when a core part of the master roller 23*a* shown in FIG. 1 is set in the master holding member 16, describes a known configuration comprising the identification display body (142) shown in FIG. 17 of the aforementioned patent application affixed to the leading-edge drawing part of the master roller 23*a*, and three reflection-type photosensors (143) shown in FIG. 17 of the aforementioned patent application as detection means for detecting the contents displayed in the identification display body (142).

Figure 19:
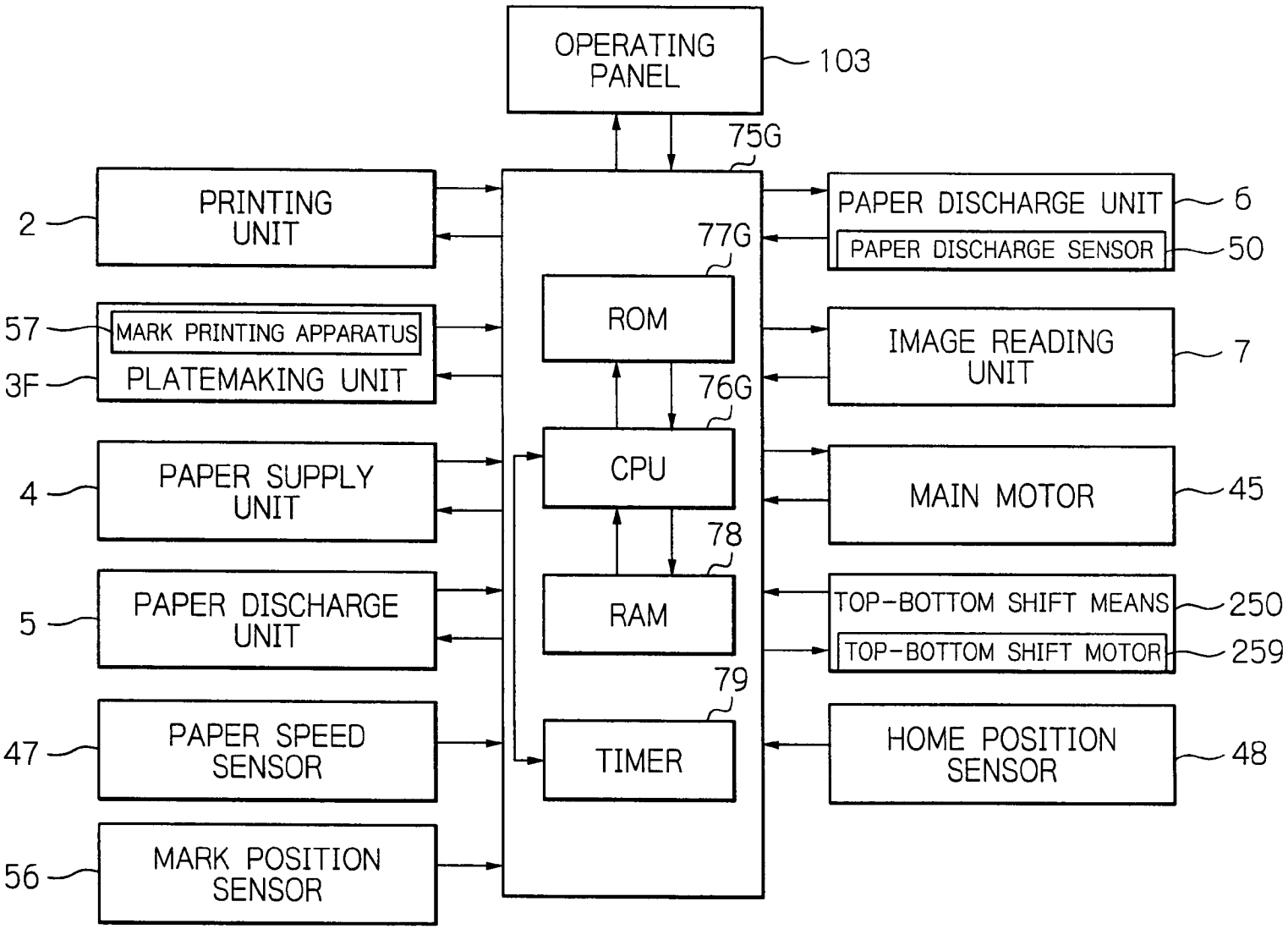
FIG. 19 is a block diagram of a control structure of a modification 13 of the fourth embodiment.

Master-type detection means 300 is not limited to the configuration described above and may be configured from either the IC tag (144) and reception means (145) shown in FIG. 19 of the aforementioned patent application, or may be designed to perform detection based on provision of a resonance tag or the like in the master roller 23*a* side, or to detect a static electricity amount and detect master type based on this value.

FIG. 8 shows some specific examples of selection patterns 1 to 10 obtained by combination of the sub-parameters of ink color, drum type, paper type, master type, ink temperature and printing speed as described above. FIG. 9 shows some of the relationships between copy number and master position displacement for each of the selection patterns 1 to 10 and N as determined from test results set in accordance therewith as top-bottom shift correction values (indicated in the diagram as "correction value" unit (mm)). While in this example the top-bottom shift correction values are listed in detail for the selection patterns 1 to 10 for every copy number of 100 copies, the top-bottom shift correction values of the selection patterns 1 to 10 may of course be given for broad copy number groups as shown in FIG. 5. In this case, the top-bottom shift correction values of the selection patterns 1 to 10 correspond to copy numbers for which calculation by CPU 76 as described in modification 1 is required.

The selection pattern N expresses a pattern obtained by combination of the predetermined printing conditions and parameters described in the first embodiment.

Control means 75A of this modification differs from control means 75 shown in FIG. 4 in that a CPU 76A is employed instead of the CPU 76, and a ROM 77A is employed instead of the ROM 77 as shown in FIG. 6. The ROM 77A differs from the ROM 77 shown in FIG. 4 only in the prestorage of the data table shown in FIG. 8 related to set contents of the selection parameters and the data table of top-bottom shift correction values shown in FIG. 9 set according to selection parameters for each copy number instead of the data table of top-bottom shift correction values shown in FIG. 5. As described above, the ROM 77A comprises a function as storage means for storing preset top-bottom shift correction values for each predetermined copy number obtained through testing based on combinations of the six parameter types.

This may also be configured so that, when there is a desire indicated by a user request for the selection patterns 1 to 10 and N of the data table shown in FIG. 9 or the top-bottom shift correction values set for each predetermined copy number in accordance therewith to be altered, the contents of the aforementioned data tables are stored in a programmable PROM or the like and varied in the same way as described above using various combinations of the keys on the operating panel.

The CPU 76A comprises a function that replaces the function of the CPU 76 shown in FIG. 4, that is to say, a function for, in accordance with output signals from the selection setting key 120*b* or ink color detection means 302, selection setting key 120*d* or drum-type detection means 303, selection setting key 120*c* or paper-type detection means 304, selection setting key 120*a* or master-type detection means 300, temperature sensor 301, printing speed setting key 113 and printing speed sensor 47 during normal printing as described above and, each time the copy number counted by paper discharge sensor 50 reaches the predetermined copy number indicated in FIG. 9, selecting patterns on the basis of correlation performed between the data tables shown in FIG. 8 and FIG. 9 stored in the ROM 77A and the aforementioned output signals, reading the top-bottom shift correction values corresponding to the selected patterns and aforementioned predetermined copy numbers, and controlling the top-bottom shift motor 259 of top-bottom shift means 250 to execute top-bottom shift correction in accordance with the read top-bottom shift correction values.

Accordingly, using modification 2, a top-bottom shift correction in accordance with a top-bottom shift correction value in which printing conditions (sub-parameters) other than the copy number are taken into account and which, accordingly, better approximates the printing conditions of an actual apparatus can be executed compared with the first embodiment.

If there is no need for a top-bottom shift correction to be executed in accordance with the top-bottom shift correction values that approximates the printing conditions of an actual apparatus to the extent as described above, an example control structure comprising means as described below in which characteristic values of a single printing condition (sub-parameter) or a combination of at least a plurality of printing conditions (sub-parameters) are set or determined and top-bottom shift correction values (adjustment values) are decided and top-bottom shift correction is executed with consideration of the characteristic values set or determined by this means may be adopted. The following description focuses on the function of the CPU alone, the particulars of which are enumerated using the symbols shown in FIG. 6.

The CPU 76A of control means 75A may comprise a function for, in accordance with an output signal from the selection setting key 120*b* or ink color detection means 302 during normal printing as described above and, each time the copy number counted by paper discharge sensor 50 reaches a predetermined copy number, performing a correlation between a data table (ink color-based top-bottom shift correction value for each copy number) stored in the ROM 77A and the aforementioned output signal, reading the ink color-based top-bottom shift correction value corresponding to the aforementioned predetermined copy number, and controlling the top-bottom shift motor 259 of top-bottom shift means 250 to execute top-bottom shift correction in accordance with the read top-bottom shift correction value (First control structure example).

The CPU 76A of control means 75A may comprise a function for, in accordance with an output signal from the selection setting key 120*d* or drum-type detection means 303 during normal printing as described above and, each time the copy number counted by paper discharge sensor 50 reaches a predetermined copy number, performing a correlation between a data table (drum type-based top-bottom shift correction value for each copy number) stored in the ROM 77A and the aforementioned output signal, reading the drum type-based top-bottom shift correction value corresponding to the aforementioned predetermined copy number, and controlling the top-bottom shift motor 259 of top-bottom shift means 250 to execute top-bottom shift correction in accordance with the read top-bottom shift correction value (Second control structure example).

The CPU 76A of control means 75A may comprise a function for, in accordance with an output signal from the selection setting key 120*c* or paper-type detection means 304 during normal printing as described above and, each time the copy number counted by paper discharge sensor 50 reaches a predetermined copy number, performing a correlation between a data table (paper type-based top-bottom shift correction value for each copy number) stored in the ROM 77A and the aforementioned output signal, reading the paper type-based top-bottom shift correction value corresponding to the aforementioned predetermined copy number, and controlling the top-bottom shift motor 259 of top-bottom shift means 250 to execute top-bottom shift correction in accordance with the read top-bottom shift correction value (Third control structure example).

The CPU 76A of control means 75A may comprise a function for, in accordance with an output signal from the selection setting key 120*a* or master-type detection means 300 during normal printing as described above and, each time the copy number counted by paper discharge sensor 50 reaches a predetermined copy number, performing a correlation between a data table (master type-based top-bottom shift correction value for each copy number) stored in the ROM 77A and the aforementioned output signal, reading the master type-based top-bottom shift correction value corresponding to the aforementioned predetermined copy number, and controlling the top-bottom shift motor 259 of top-bottom shift means 250 to execute top-bottom shift correction in accordance with the read top-bottom shift correction value (Fourth control structure example).

The CPU 76A of control means 75A may comprise a function for, in accordance with an output signal from the temperature sensor 301 during normal printing as described above and, each time the copy number counted by paper discharge sensor 50 reaches a predetermined copy number, performing a correlation between a data table (ink temperature-based top-bottom shift correction value for each copy number) stored in the ROM 77A and the aforementioned output signal, reading the ink temperature-based top-bottom shift correction value corresponding to the aforementioned predetermined copy number, and controlling the top-bottom shift motor 259 of top-bottom shift means 250 to execute top-bottom shift correction in accordance with the read top-bottom shift correction value (Fifth control structure example).

The CPU 76A of control means 75A may comprise a function for, in accordance with output signals from the printing speed setting key 113 and printing speed sensor 47 during normal printing as described above and, each time the copy number counted by paper discharge sensor 50 reaches a predetermined copy number, performing a correlation between a data table (printing speed-based top-bottom shift correction value for each copy number) stored in the ROM 77A and the aforementioned output signals, reading the printing speed-based top-bottom shift correction value corresponding to the aforementioned predetermined copy number, and controlling the top-bottom shift motor 259 of top-bottom shift means 250 to execute top-bottom shift correction in accordance with the read top-bottom shift correction value (Sixth control structure example).

While in the first embodiment and modifications 1 and 2 thereof described above top-bottom shift correction is automatically executed during printing by control means, using this kind of automatic top-bottom shift correction there may be times when, for some reason or another, the printing position cannot be properly adjusted when printing is being performed. In such cases, it is preferable for switching means for switching between a necessity or unnecessity of the top-bottom shift correction described above by control means according to user preference or need to be provided.

An example of switching means described above is a means based on, for example, necessity or unnecessity of automatic top-bottom shift correction being programmed as an initial setting and entered into a PROM or the like which is able to be switched by a user using a combination of various keys on an operating panel or by provision of a special-purpose key.

Accordingly, using the example described above, the necessity or unnecessity for top-bottom shift correction to be performed by control means can be switched in accordance with user preference or need and, accordingly, the operability and usability of the stencil printing apparatus is improved.

Second Embodiment

Figure 11:
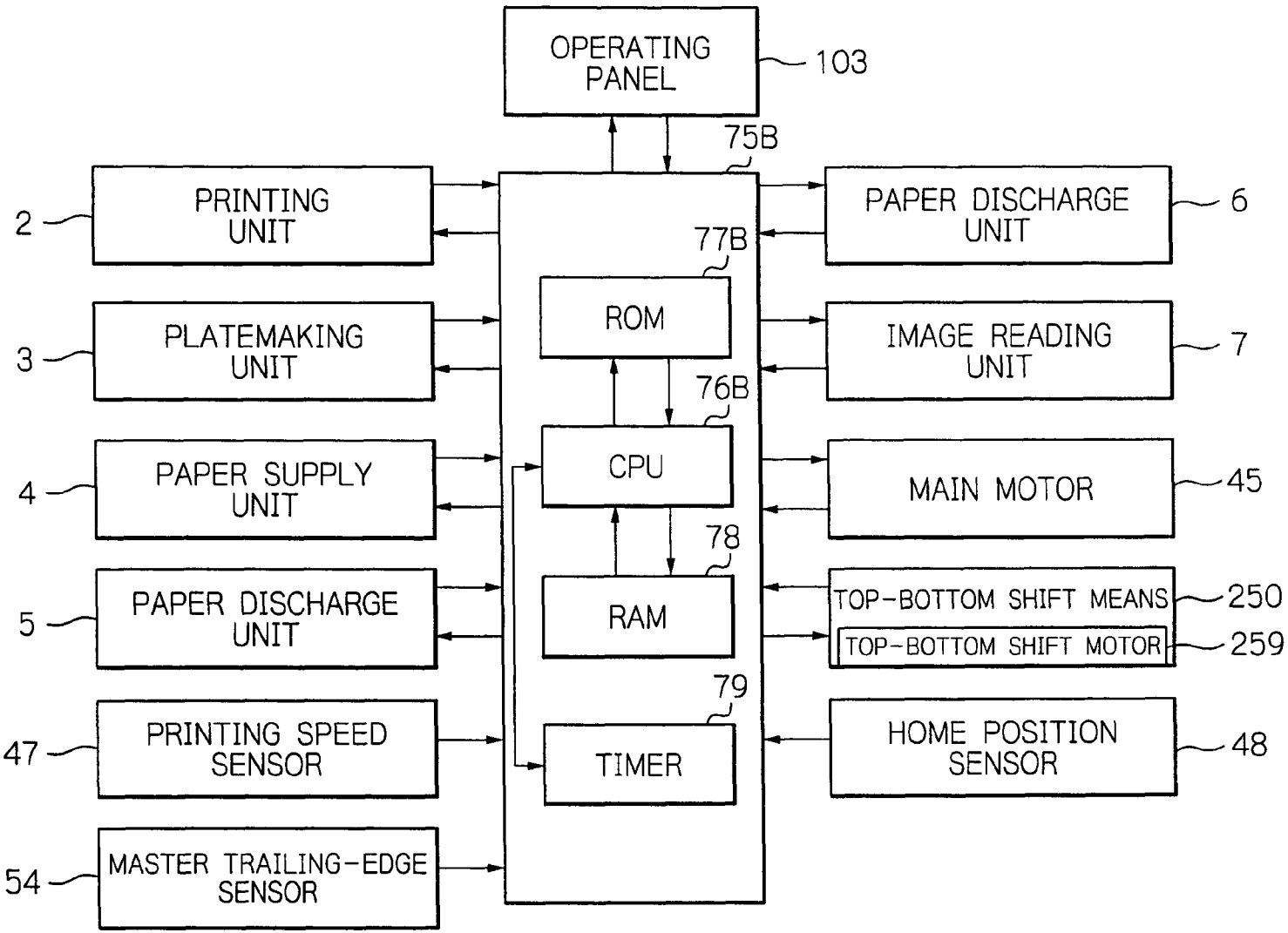
FIG. 11 is a block diagram of a control structure of a second embodiment.

FIG. 10 and FIG. 11 show a second embodiment. The second embodiment differs principally from the first embodiment shown in FIGS. 1 to 5 in the employment of a master trailing-edge sensor 54 as shown in FIG. 10 and FIG. 11 as master trailing-edge detection means for detecting the position of the trailing edge of the symbols 55 of the master 23 on the plate cylinder 9 instead of the paper discharge sensor 50, and the employment of control means 75B instead of control means 75. The remainder of the configuration is identical to the stencil printing apparatus 1 of the first embodiment. The symbols 55 and 56 enclosed by parentheses of FIG. 10 do not denote component parts employed in the second embodiment but instead denote component parts used in the later-described third and fourth embodiments that are indicated here for reasons of simplification of the description.

The master trailing-edge sensor 54 is configured from, for example, a reflection-type photosensor. As shown in FIG. 10, while the printed master 23 is affixed to the outer circumferential surface of the plate cylinder 9 by the adhesion strength of the ink that exudes through an aperture portion thereof to a trailing edge of an aperture portion (upstream edge portion) of the plate cylinder 9 in the rotating direction, a trailing-edge portion 53 of the master 23 beyond the trailing edge of the aperture portion of the plate cylinder 9 does not affix to the outer circumferential surface of the plate cylinder 9 and instead exists in a raised free state above the outer circumferential surface of the plate cylinder 9. The master trailing-edge sensor 54 is mounted and fixed to the apparatus main body by way of a sensor bracket not shown in the diagram located in the vicinity of the position of the trailing edge 52 of the master 23 in order to detect the position of the trailing edge 52 of the master 23 on the plate cylinder 9.

Control means 75B of this embodiment differs principally from control means 75 shown in FIG. 4 in the employment of, as shown in FIG. 11, a CPU 76B instead of the CPU 76, and the employment of a ROM 77B instead of the ROM 77. The ROM 77B differs from the ROM 77 shown in FIG. 4 in the prestorage therein of a calculation program for implementing a later-described calculation function peculiar to the CPU 76B and a top-bottom shift correction threshold pertaining to master position displacement amount for determining top-bottom shift correction necessity instead of the data table of top-bottom shift correction values shown in FIG. 5.

The CPU 76B comprises a function that replaces the function of the CPU 76 shown in FIG. 4, that is to say, a function for computing top-bottom shift correction values during normal printing described above by performing a calculation based on a master trailing-edge position data signal from the master trailing-edge sensor 54 that indicates the position of the trailing edge 52 of the master 23 on the plate cylinder 9, and controlling the top-bottom motor 259 of top-bottom shift correction means 250 to execute a top-bottom shift correction in accordance with the computed top-bottom shift correction values.

Trailing-edge position length of the master 23 on the plate cylinder. 9 can be determined for the purpose of the computation of top-bottom shift correction values performed CPU 76B by a calculation based on master trailing-edge position data in accordance with a peripheral speed value obtained by calculation of peripheral speed of the plate cylinder 9 based on printing speed data sent from the printing speed sensor 47 and measured time data sent from the timer 79, that is to say, in accordance with measured time data of an output signal of the master trailing-edge position detected by the master trailing-edge sensor 54 for a single rotation of the plate cylinder 9. The CPU 76B performs the calculation described above during normal printing for each single rotation (copy number) of the plate cylinder 9 and determines a difference thereof with the trailing-edge position length of the aforementioned master 23 at the start of normal printing, that is to say, a master position displacement amount for each single rotation (copy number) of the plate cylinder 9 and, if the master position displacement length exceeds a top-bottom shift correction threshold stored in the ROM 77B (for example, 0.2 mm as a difference between the trailing-edge position length of the master 23 of a previous print and the trailing-edge position length of the master 23 of a subsequent print), executes the above-described top-bottom shift correction with the aforementioned master position displacement amount reckoned as the top-bottom shift correction value.

Accordingly, using the second embodiment, because the CPU 76B of control means 75B computes the master position displacement amount during normal printing by performing a calculation based on master trailing-edge position data pertaining to the position of the trailing edge 52 of the master 23 on the plate cylinder 9 from the master trailing-edge sensor 54, reckons this amount as a top-bottom shift correction value, and controls the top-bottom motor 259 of top-bottom shift correction means 250 to execute the top-bottom shift correction in accordance with the calculated top-bottom shift correction value, even if master position displacement occurs printing position displacement can be prevented from occurring and a printed material free of printing position displacement can be produced and, in turn, master and paper waste can be eliminated, the operation time can be shortened, and the number of operation steps can be reduced.

This second embodiment is additionally advantageous in that, because the master position displacement amount is determined by a calculation based on detection and measurement of the position of the trailing edge 52 of the master 23 on the plate cylinder 9 as a result reflecting the actual printing conditions of an actual apparatus, the many steps implemented in the testing carried out in the first embodiment and modifications 1 and 2 thereof in order to obtain a master position displacement amount in accordance with copy number and each parameter including master type and paper type and so on along with the complicated action pertaining to storage in the ROM 77 or ROM 77A of the various data obtained thereby are eliminated. Accordingly, it is essential that this embodiment be configured in a way that allows the position of the trailing edge 52 of the master 23 on the plate cylinder 9 to be accurately detected and measured (the same applies for the later-described third and fourth embodiments and the various modifications thereof).

Modification 3 of Second Embodiment

Because the trailing edge 52 of the master 23 on the plate cylinder 9 does not affix to the outer circumferential surface of the plate cylinder 9 as shown in FIG. 10 and instead exists in a raised free state from the outer circumferential surface of the plate cylinder 9, accurate detection and measurement of the master 23 on the plate cylinder 9 is difficult. Modification 3 of the second embodiment is devised with this in mind.

FIG. 12 shows modification 3 of the second embodiment. The modification 3 differs from the second embodiment shown in FIG. 10 and FIG. 11 only in the arrangement of the master trailing-edge sensor 54 in a different position on the outer side of the outer circumferential surface of the plate cylinder 9 in the vicinity of a nip portion (clasping portion) between the plate cylinder 9 and the press roller 10 as shown in FIG. 12. The symbol 56 enclosed by parentheses of FIG. 12 does not denote a component part employed in the modification 3 but instead denotes a component part used in the later-described modifications of third and fourth embodiments that is indicated here for reasons of simplification of the description.

The adoption of this configuration is preferable in that, when printing pressure is applied by the press roller 10 during printing as shown in FIG. 12, the printing pressure range (pressing range) of the press roller 10 extends to the upstream side in the rotating direction of the plate cylinder 9 in such a way as to apply printing pressure to the trailing edge 52 of the master 23. Because, as a result, the position of the trailing edge 52 of the master 23 on the plate cylinder 9 is formed in a more stabilized state than in the second embodiment and, in addition, the master trailing-edge sensor 54 is arranged in the vicinity of the nip portion between the plate cylinder 9 and press roller 10, the position of the trailing edge 52 of the master 23 on the plate cylinder 9 can be accurately detected and measured.

Accordingly, using modification 3, because the problems inherent to the second embodiment described above are resolved and, as a result, the position of the trailing edge 52 of the master 23 on the plate cylinder 9 can be accurately measured, detected and calculated in a in a more stable state than in the second embodiment, accurate top-bottom shift correction can be executed.

Modification 4 of Second Embodiment

In modification 3 described above, when the master trailing-edge sensor 54 is arranged as shown in FIG. 12 in a different position on the outer side of the outer circumferential surface of the plate cylinder 9 in the vicinity of a nip portion (clasping portion) between the plate cylinder 9 and the press roller 10 in order to accurately measure the position of the trailing edge 52 of the printed master 23 on the plate cylinder, printing pressure is applied to the trailing edge 52 of the master 23 when, as illustrated in the same diagram, printing pressure is produced by the elevation and swing of the press roller 10 when printing is performed. However, the arrangement of the master trailing-edge sensor 54 in the nip portion where the plate cylinder 9 and press roller 10 come into contact involves a layout thereof forward and rear of the nip position (downstream side or upstream side about the nip portion in the paper conveyance direction) which, with the conveyance of the paper in mind, renders accurate detection and measurement of the trailing-edge position of the master 23 difficult. Modification 4 of the second embodiment has been devised to resolve this problem.

Figure 13:
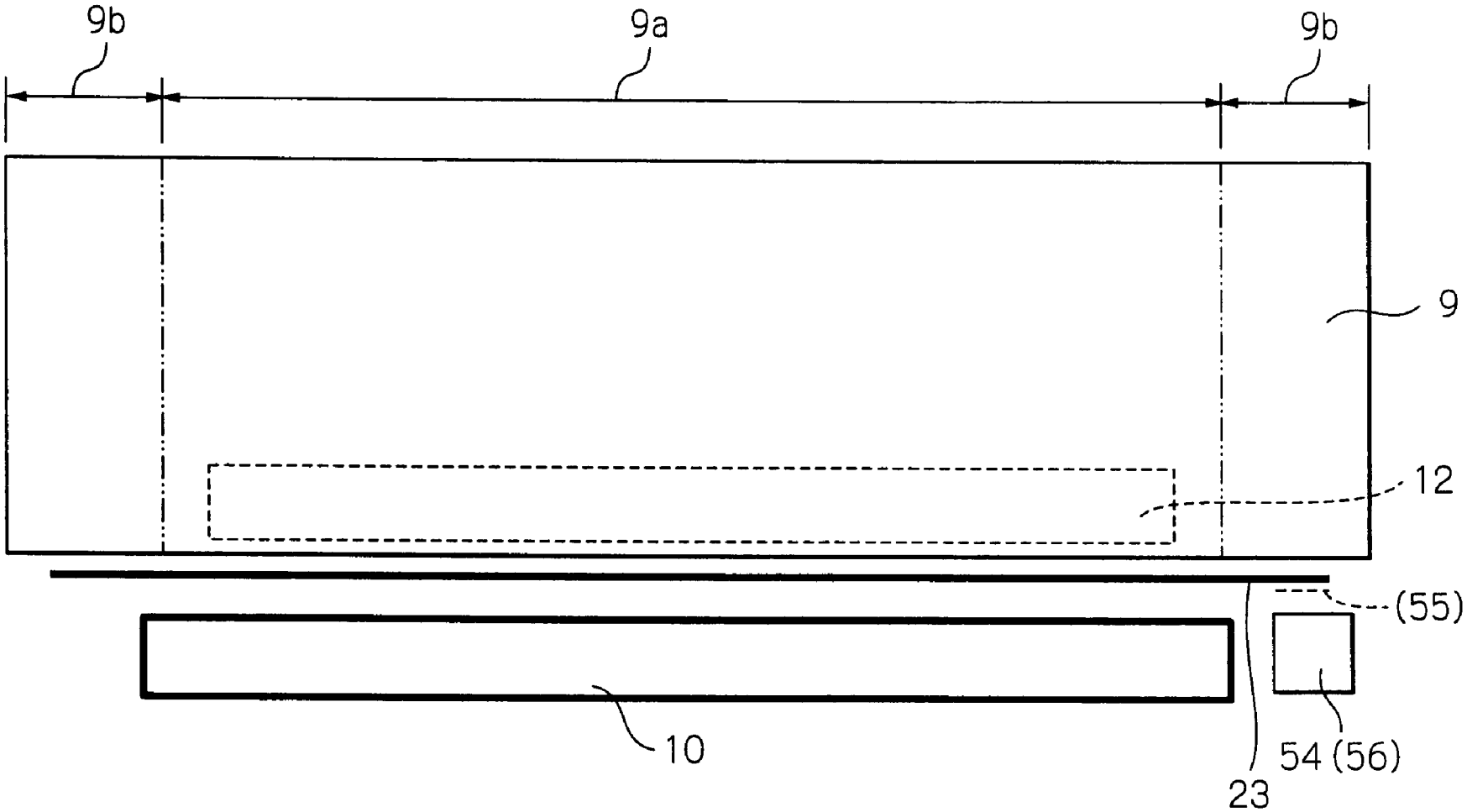
FIG. 13 is a schematic side view as seen from a paper discharge tray of modifications of each of the second to fourth embodiments showing a further example arrangement of a master trailing-edge sensor and mark position sensor for detecting the trailing-edge position and trailing edge mark position of a master on a plate cylinder.

FIG. 13 shows modification 4 of the second embodiment. As shown in FIG. 13, modification 4, in which the master trailing-edge sensor 54 is arranged in a position on the outer side of the outer circumferential surface on the plate cylinder 9 in the vicinity of the nip portion between the plate cylinder 9 and the press roller 10 (clasping portion), differs from modification 3 shown in FIG. 12 only in the arrangement thereof to facilitate detecting the trailing edge 52 of the master 23 in the outer side in the plate cylinder width direction of the aperture portion 9*a* on the plate cylinder 9, that is to say, in the non-aperture portion 9*b* in the plate cylinder width direction. The problems of modification 3 are resolved as a result and, accordingly, the position of the trailing edge 52 of the master 23 on the plate cylinder 9 can be accurately detected and measured.

Accordingly, using modification 4, because the problems of modification 3 are resolved and, as a result, more accurate detection, measurement and calculation of the position of the trailing edge 52 of the master 23 on the plate cylinder 9 is possible than in modification 3, more accurate execution of top-bottom shift correction is afforded thereby.

The symbols 55 and 56 enclosed by parentheses of FIG. 13 do not denote component parts employed in modification 3 but instead denote component parts used in the later-described third and fourth embodiments that are indicated here for reasons of simplification of the description.

Modification 5 of Second Embodiment

Figure 14:
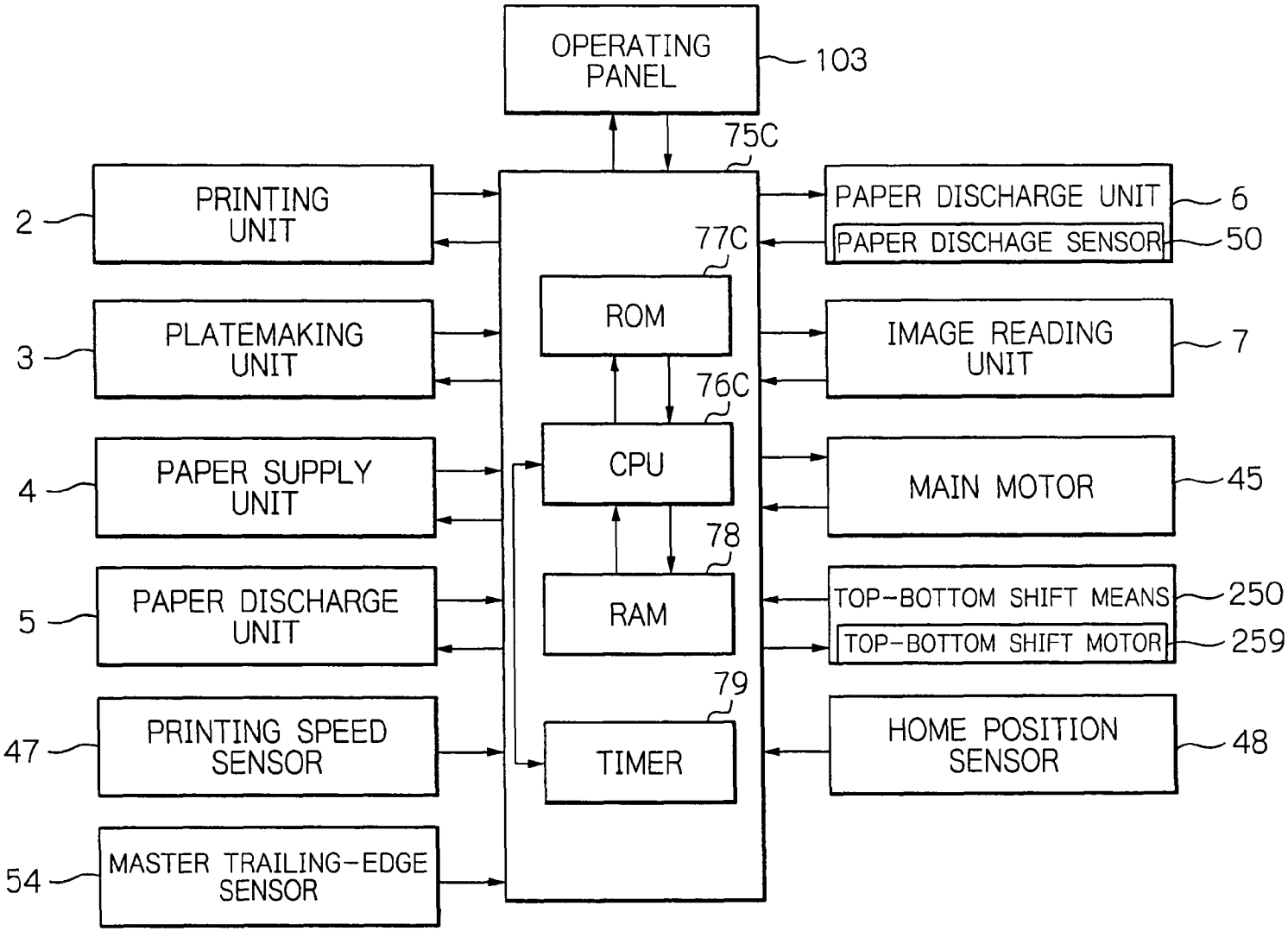
FIG. 14 is a block diagram of a control structure of a modification 5 of the second embodiment.

FIG. 14 shows a modification 5 of the second embodiment. Modification 5 differs from the second embodiment shown in FIG. 10 and FIG. 11 in the use of a signal pertaining to copy number from the paper discharge sensor 50, and in the employment of control means 75C instead of control means 75.

As shown in FIG. 14, control means 75C of this modification differs principally from control means 75B shown in FIG. 11 in the employment of a CPU 76C is instead of the CPU 76B, and the use of a ROM 77C instead of the ROM 77B.

The ROM 77C differs from the ROM 77B shown in FIG. 11 only in the prestorage therein of a calculation program for implementing a calculation function The CPU 76C comprises a function that replaces the function of the CPU 76B shown in FIG. 11, that is to say, a function for, during normal printing as described above, computing a top-bottom shift correction value by performing a calculation based on a master trailing-edge position data signal pertaining to the position of the trailing edge 52 of the master 23 on the plate cylinder 9 from the master trailing-edge sensor 54 each time a signal pertaining to copy number from the paper discharge sensor 50 reaches a preset predetermined copy number, and controlling the top-bottom motor 259 of top-bottom shift correction means 250 to execute a top-bottom shift correction in accordance with the computed top-bottom shift correction value. The particulars of the computation of top-bottom shift correction value based on the calculation of master trailing-edge position data performed by the CPU 76C are identical to those of the CPU 76B shown in FIG. 11.

Accordingly, using modification 5, because the CPU 76C of control means 75C needs only to perform a calculation during normal printing the same as that performed by the CPU 76B shown in FIG. 11 each time a preset predetermined copy number (for example, copy number the same as shown in FIG. 5) is reached, and to control the top-bottom motor 259 of top-bottom shift correction means 250 to execute a top-bottom shift correction in accordance with the computed top-bottom shift correction value, the need for a calculation as described above to be performed for each individual copy number as is the case with the CPU 76B shown in FIG. 11 and, in turn, for a top-bottom shift correction command to be issued in response to the computed top-bottom shift correction value is eliminated and, accordingly, the control operation thereof is simplified.

Modification 6 of Second Embodiment

Modification 6 of the second embodiment differs from the second embodiment shown in FIGS. 1 to 5 only in that the following function is additionally imparted to control means 75B shown in FIG. 11. That is to say, CPU 77B of control means 75B comprises an additional function for executing the top-bottom shift correction described above at every rotation on the plate cylinder 9 subsequent to printing using the same printed master 23 on the plate cylinder 9 being temporarily stopped and prior to it being restarted.

In this modification, and in particular when printing position correction (top-bottom shift correction) for continuous printing is implemented, the master trailing-edge sensor 54 is employed to detect and measure the position of the trailing edge 52 of the master 23 on the plate cylinder 9 during a period of idling prior to continuous printing employing the same printed master 23 on the plate cylinder 9 being started, and top-bottom shift correction is executed for each individual sheet following the start of printing in accordance with the top-bottom shift correction value obtained by a calculation in the same way as described above. Because the printing position is corrected following detection at every rotation of the plate cylinder 9 for the second and subsequent sheets of paper, printing position displacement does not occur. Accordingly, a top-bottom shift correction (printing position correction) for continuous printing can be executed, and the plate cylinder idling period can be utilized to execute this printing position correction. Naturally, this modification is also able to have application in modification 3 and modification 5 of the second embodiment.

Third Embodiment

Figure 15:
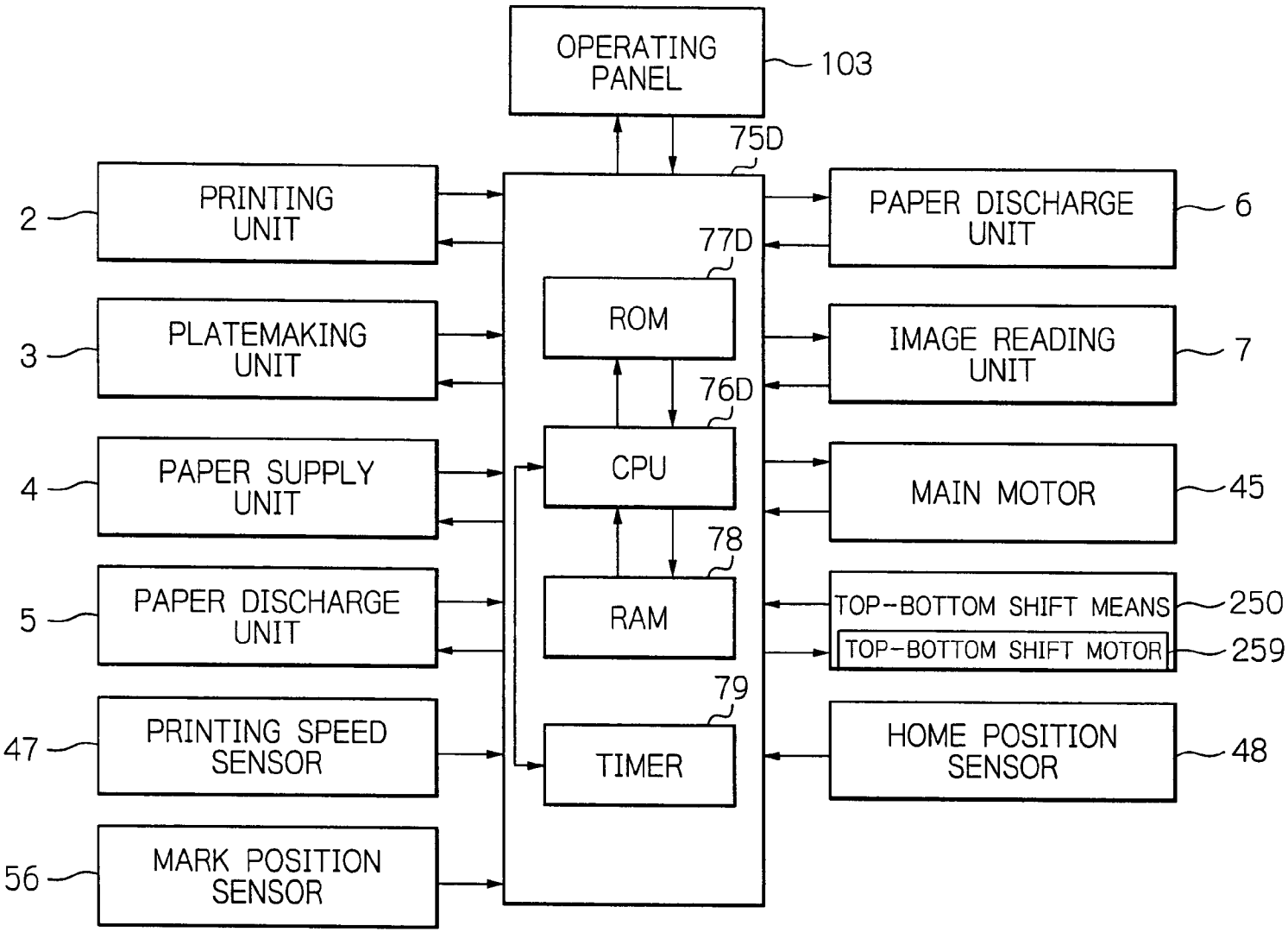
FIG. 15 is a block diagram showing a control structure of the third embodiment.

FIG. 10 and FIG. 15 show a third embodiment. The third embodiment differs principally from the second embodiment shown in FIG. 10 and FIG. 11 in the employment of, as a master scroll, a master 23 on which a mark 55 (shown by the broken line in this diagram) denoted by parentheses in FIG. 10 serving as one example of a mark used for detecting a 1-plate master length wound around the plate cylinder 9, the employment of a mark position sensor 56 instead of the master trailing-edge sensor 54 as master mark detection means for detecting the position of the mark 55 of the printed master 23 on the plate cylinder 9, and the employment of control means 75D instead of control means 75B. The remainder of the configuration is the identical to the stencil printing apparatus 1 of the second embodiment.

The mark 55, which is preprinted on a master scroll used in the stencil printing apparatus 1, is printed in a position on an upstream-edge portion (trailing-edge portion of the master 23) in the direction of rotation on the plate cylinder 9 with the position thereof in each individual plate being maintained at an appropriate interval when wrapped around the outer circumferential surface of the plate cylinder 9. With the reflectivity of light of, for example, the thermoplastic resin film from which the master 23 is configured in mind, the mark 55 is printed in black to ensure good detection sensitivity, and it is printed in a striped-shape parallel to the width direction of the master.

The mark position sensor 56 is configured from, for example, a reflection-type photosensor. As shown in FIG. 10, while the printed master 23 is affixed to the outer circumferential surface of the plate cylinder 9 by the adhesion strength of the ink that exudes through the aperture portion to the trailing edge of the aperture portion in the rotating direction of the plate cylinder 9 (upstream-edge portion), the trailing-edge portion 53 of the master 23 located beyond the trailing edge of the aperture portion on the plate cylinder 9 does not affix to the outer circumferential surface of the plate cylinder 9 and instead exists in a raised free state above the outer circumferential surface of the plate cylinder 9. The mark position sensor 56 is mounted and fixed to the apparatus main body by way of a sensor bracket not shown in the diagram located in the vicinity of the position of the mark 55 of the master 23 to detect the position of the mark 55 of the trailing edge 52 of the master 23 on the plate cylinder 9.

The mark for detecting master length is not limited to the printed mark 55 as described above and, provided it facilitates accurate and reliable detection of master length the mark may, for example, describe a rectangular or triangular shape, or a mark produced by printing by means of an ink jet or the like may be used. Master mark detection means is not limited to the mark position sensor 56, and any detection means may be used provided it facilitates precise and reliable detection of the mark position printed on the master 23. Master mark detection means are always arranged in the same position.

The master scroll in which the mark 55 for detecting the trailing edge 52 of the master 23 is printed is set so that, when it is set in the master holding member 16 shown in FIG. 1, the mark is positioned on the trailing edge of the master 23 when platemaking is performed. The leading edge of the master 23 may be set by manual positioning, or it may be set by automatic detection of the mark position. The mark 55 is printed to conform to the platemaking length on the master 23 on which the mark 55 for detecting the trailing edge 52 of the master 23 is printed.

Naturally, the plate supply and wrapping operations are implemented so that, when the aforementioned master 23 is wrapped around the plate cylinder 9, the mark 55 is positioned at the trailing edge 52 of the master 23. The mark position sensor 56 is arranged so as to be able to detect and measure the length of the master 23 on the plate cylinder 9 by detecting the mark position of the master 23 on the plate cylinder 9.

As shown in FIG. 15, control means 75D of this embodiment differs principally from control means 75B shown in FIG. 11 in the employment of a CPU 76D instead of the CPU 76B, and in the employment of a ROM 77D instead of the ROM 77B. The ROM 77D differs from the ROM 77B shown in FIG. 11 only in the prestorage therein of a calculation program for implementing a later-described calculation function peculiar to the CPU 76C.

The CPU 76D comprises a calculation function that resembles the calculation function of the CPU 76B, that is to say, a function for computing a top-bottom shift correction value by performing a calculation based on a master trailing-edge position data signal from the mark position sensor 56 as master length data pertaining to position of mark 55 of the master 23 on the plate cylinder 9, and controlling the top-bottom motor 259 of top-bottom shift correction means 250 to execute a top-bottom shift correction in accordance with the computed top-bottom correction value. The particulars of the computation of the top-bottom correction value based on the calculation performed by the CPU 76D based on the master trailing-edge position data are the same as those of the CPU 76B.

Accordingly, using the third embodiment, because the CPU 76D of control means 75D computes a master position displacement amount by performing a calculation based on master trailing-edge position data pertaining to the trailing-edge position of the mark 55 of the master 23 on the plate cylinder 9 from the mark position sensor 56 during normal printing and, reckoning this as a top-bottom shift correction value, controls the top-bottom motor 259 of top-bottom shift correction means 250 to execute the top-bottom shift correction in accordance with the computed top-bottom shift correction value, even if master position displacement occurs printing position displacement can be prevented from occurring and a printed material free of printing position displacement can be produced and, in turn, master and paper waste can be eliminated, the operation time can be shortened, and the number of operation steps can be reduced. In addition, in the third embodiment, the detection and measurement of the trailing-edge position of the mark 55 of the master 23 on the plate cylinder 9 is better than the detection and measurement of the trailing edge 52 of the master 23 on the plate cylinder 9 of the second embodiment and, accordingly, the precision of the top-bottom correction (printing position correction) is improved to the extent of this improved detection and measurement.

Modification 7 of Third Embodiment

Because the mark trailing edge of the master 23 on the plate cylinder 9 does not affix to the outer circumferential surface of the plate cylinder 9 as shown in FIG. 10 and instead exists in a raised free state from the outer circumferential surface of the plate cylinder 9, this renders accurate detection and measurement of the position of the trailing edge of the master 23 on the plate cylinder 9 difficult. Modification 7 of the third embodiment is devised with this in mind.

FIG. 12 shows modification 7 of the second embodiment. Modification 7 differs from the third embodiment shown in FIG. 10 and FIG. 15 only in the arrangement of the mark position sensor 56 as shown in FIG. 12 in a different position on the outer side of the outer circumferential surface of the plate cylinder 9 in the vicinity of a nip portion (clasping portion) between the plate cylinder 9 and the press roller 10.

This configuration is preferable in that, when printing pressure is applied by the press roller 10 during printing as shown in FIG. 12, the printing pressure range (pressing range) of the press roller 10 extends to the upstream side in the rotating direction of the plate cylinder 9 in such a way as to apply printing pressure to the trailing edge of the master 23. Because, as a result, the position of the trailing edge of the mark 55 of the master 23 on the plate cylinder 9 is formed in a more stabilized state than in the third embodiment and, in addition, because the mark position sensor 56 is arranged in the vicinity of the nip portion between the plate cylinder 9 and press roller 10, the position of the mark 55 of the master 23 on the plate cylinder 9 can be accurately detected and measured.

Accordingly, using modification 7, because the problems inherent to the third embodiment described above are resolved and, as a result, the position of the mark 55 of the master 23 on the plate cylinder 9 can be accurately measured, detected and calculated in a more stable state than in the third embodiment, accurate top-bottom shift correction can be executed.

Modification 8 of Third Embodiment

In modification 7 described above, when the mark position sensor 56 is arranged as shown in FIG. 12 in a different position on the outer side of the outer circumferential surface of the plate cylinder 9 in the vicinity of a nip portion (clasping portion) between the plate cylinder 9 and the press roller 10 in order to accurately measure the position of the mark 55 of the printed master 23 on the plate cylinder, printing pressure is applied to the mark 55 of the master 23 when, as illustrated in the same diagram, printing pressure is produced by the elevation and swing of the press roller 10 when printing is performed. However, the arrangement of the mark position sensor 56 in the nip portion where the plate cylinder 9 and press roller 10 come into contact involves a layout thereof forward and rear of the nip position (downstream side or upstream side about the nip portion in the paper conveyance direction) which, with the conveyance of the paper in mind, renders accurate detection and measurement of the trailing-edge position of the master 23 difficult. Modification 8 of the third embodiment has been devised to resolve this problem.

FIG. 13 shows modification 8 of the third embodiment. As shown in FIG. 13, modification 8, in which the mark position sensor 56 is arranged in a position on the outer side of the outer circumferential surface on the plate cylinder 9 in the vicinity of the nip portion between the plate cylinder 9 and the press roller 10 (clasping portion), differs from modification 7 shown in FIG. 12 only in the arrangement thereof in the outer side in the plate cylinder width direction of the aperture portion 9*a*, that is to say, in the non-aperture portion 9*b* in the plate cylinder width direction on the plate cylinder 9 to be able to detect the mark 55 of the master 23. The problems of modification 7 are resolved as a result and, accordingly, the position of the mark 55 of the master 23 on the plate cylinder 9 can be accurately detected and measured.

Accordingly, using modification 8, because the problems of modification 7 are resolved and, as a result, the position of the trailing edge of the mark 55 of the master 23 on the plate cylinder 9 can be more accurately detected, measured and calculated than in modification 7, more accurate top-bottom shift correction can be executed.

Modification 9 of Third Embodiment

Figure 16:
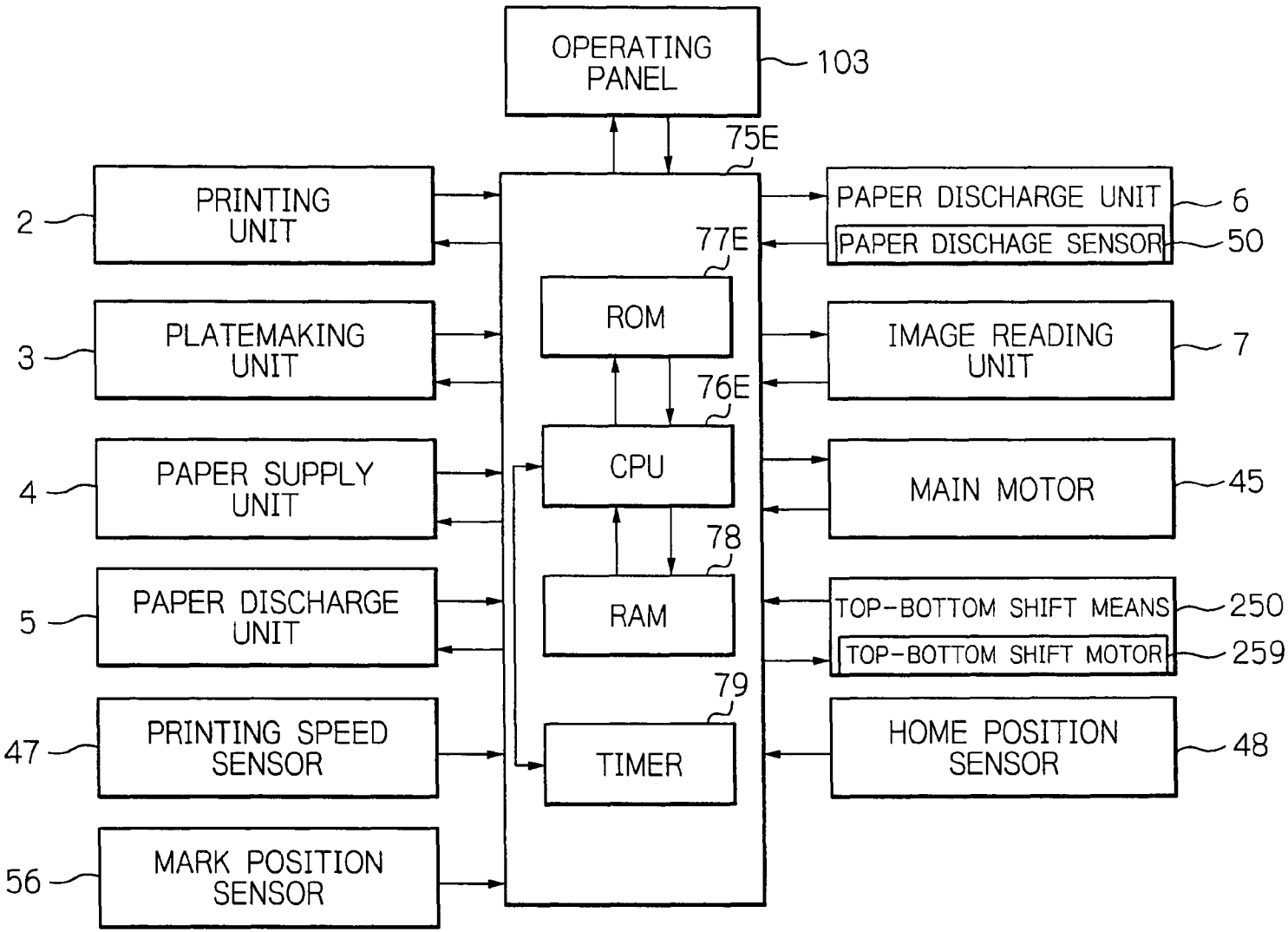
FIG. 16 is a block diagram of a control structure of a modification 9 of the third embodiment.

FIG. 16 shows a modification 9 of the third embodiment. Modification 9 differs from the third embodiment shown in FIG. 10 and FIG. 15 in the use of a signal pertaining to copy number from the paper discharge sensor 50, and in the employment of control means 75E instead of control means 75D.

As shown in FIG. 16, control means 75E of this modification differs principally from control means 75D shown in FIG. 15 in the employment of a CPU 76E instead of the CPU 76D, and the employment of a ROM 77E instead of the ROM 77D.

The ROM 77E differs from the ROM 77D shown in FIG. 15 in the prestorage therein of a calculation program for implementing a later-described calculation function peculiar to the CPU 76E.

The CPU 76E comprises a function that replaces the function of the CPU 76D shown in FIG. 15, that is to say, a function for, during the normal printing as described above, computing a top-bottom shift correction value by performing a calculation based on a master trailing edge-position data signal from the mark position sensor 56 pertaining to the trailing-edge position of the mark 55 of the master 23 on the plate cylinder 9 each time a signal pertaining to copy number from the paper discharge sensor 50 reaches a preset predetermined copy number, and controlling the top-bottom motor 259 of top-bottom shift correction means 250 to execute a top-bottom shift correction is executed in accordance with the computed top-bottom shift correction value. The particulars of the computation of top-bottom shift correction value based on the calculation of master trailing-edge position data performed by the CPU 76E are identical to those of the CPU 76D shown in FIG. 15.

Accordingly, using modification 9, because the CPU 76E of control means 75E needs only to perform a calculation during normal printing the same as that performed by the CPU 76D shown in FIG. 15 each time a preset predetermined copy number (for example, copy number the same as shown in FIG. 5) is reached, and to control the top-bottom motor 259 of top-bottom shift correction means 250 to execute a top-bottom shift correction in accordance with the computed top-bottom shift correction value, the need for a calculation as described above to be performed for each individual copy number as is the case with the CPU 76D shown in FIG. 15 and, in turn, for a top-bottom shift correction command to be issued in response to the computed top-bottom shift correction value is eliminated and, accordingly, the control operation thereof is simplified.

Modification 10 of Third Embodiment

Modification 10 of the third embodiment differs from the third embodiment shown in FIGS. 10 to 15 only in that the following function is additionally imparted to control means 75D shown in FIG. 15. That is to say, CPU 76D of control means 75D comprises an additional function for executing the top-bottom shift correction described above at every rotation on the plate cylinder 9 subsequent to printing using the same printed master 23 on the plate cylinder 9 being temporarily stopped and prior to it being restarted.

In this modification, and in particular when printing position correction (top-bottom shift correction) for continuous printing is implemented, the mark position sensor 56 is employed to detect and measure the position of the trailing edge 52 of the master 23 on the plate cylinder 9 during a period of idling prior to continuous printing employing the same printed master 23 on the plate cylinder 9 being started, and top-bottom shift correction is executed for each individual sheet following the start of printing in accordance with the top-bottom shift correction value obtained by a calculation in the same way as described above. Because the printing position is corrected following detection at every rotation of the plate cylinder 9 for the second and subsequent sheets of paper, printing position displacement does not occur. Accordingly, a top-bottom shift correction (printing position correction) for continuous printing can be executed, and the plate cylinder idling period can be utilized to execute this printing position correction. Naturally, this modification is also able to have application in modification 7 to modification 9 of the third embodiment.

The configuration is not limited to the configurations of the third embodiment and modifications 7 and 9, and the following example configuration is also possible. That is to say, the position that the mark 55 is printed on the master 23 wound as a master scroll is not limited to the position described above and, for the purpose of improving detection and measurement precision of master position displacement, it may be positioned so that the shift of the mark position can be measured and detected in the master position displacement range, that is to say, for example, in a position when wrapped around the plate cylinder 9 on the upstream-edge portion in the rotating direction of the plate cylinder of the aperture portion of the plate cylinder 9, in other words, in a position of the trailing-edge portion of the master 23 on the plate cylinder 9 where it is closely adhered to the outer circumferential surface of the plate cylinder by exuded ink. In addition, the mark position sensor 56 may be arranged in a position where the mark 55 of the master 23 is closely adhered to the plate cylinder 9 (this is the same for the later-described fourth embodiment and modifications thereof).

Fourth Embodiment

In the third embodiment and modifications 7 to 10 thereof described above, employing a master 23 in which a mark 55 for detecting the length of the master 23 on the plate cylinder 9 is preprinted in the master scroll used to detect the trailing edge of the master 23, platemaking must be performed in such a way that the mark position is arranged at the trailing edge of the master 23 when platemaking is performed. For this reason, the leading edge of the master 23 must be set in a predetermined position within the platemaking unit 3 at the start of platemaking, and this necessitates either a manual or an automatic setting thereof. In addition, while the mark 55 for detecting the trailing edge of the master 23 must be printed on the master 23 for each individual plate to be wrapped around the plate cylinder 9, if a 1-plate segment is not able to be provided due to a platemaking malfunction or the like, the master 23 must be cut and repositioned. The fourth embodiment has been devised to resolve this problem.

Figure 17:
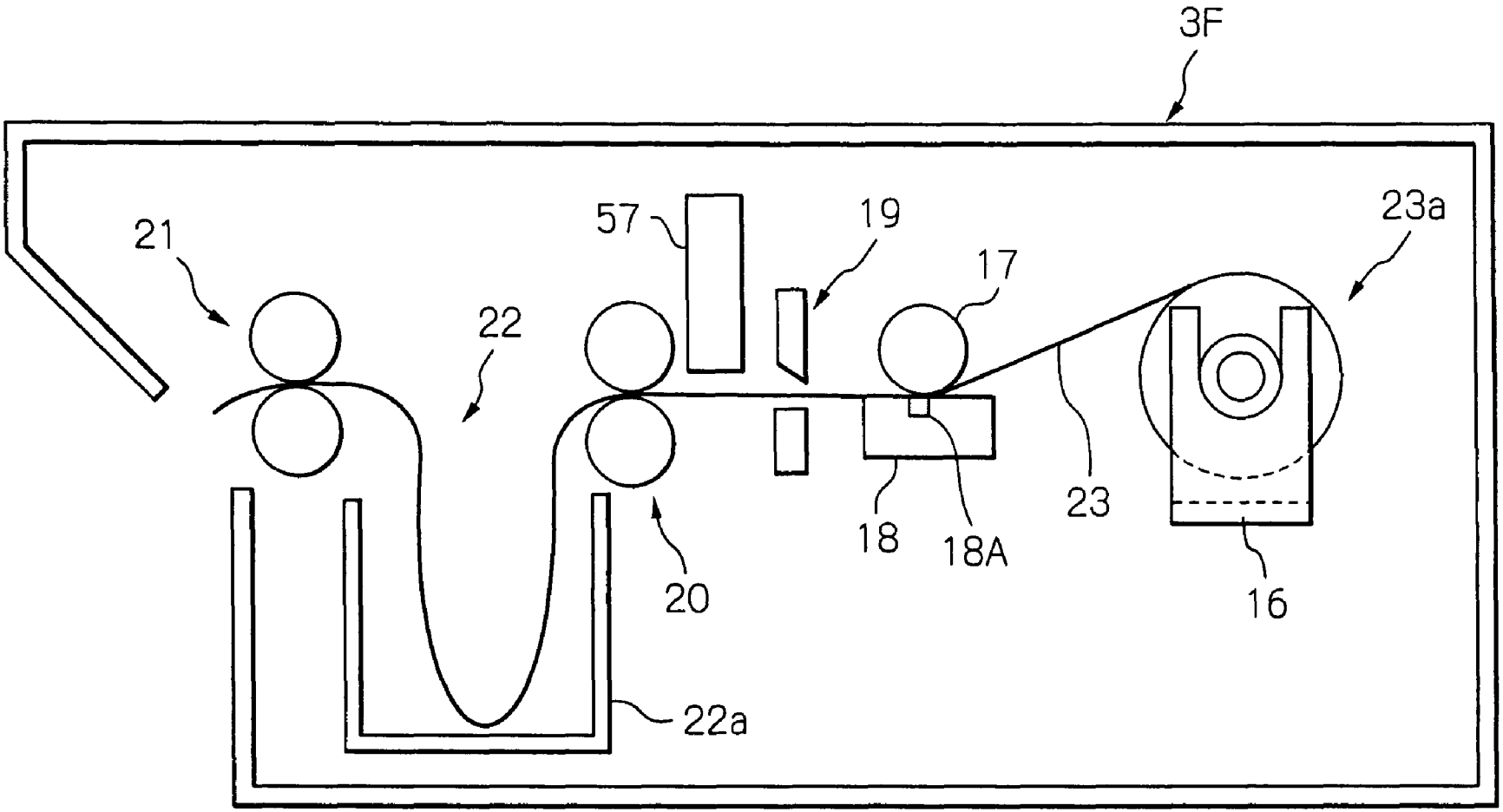
FIG. 17 is a front view of a main part of the configuration of a platemaking unit of the fourth embodiment.
Figure 18:
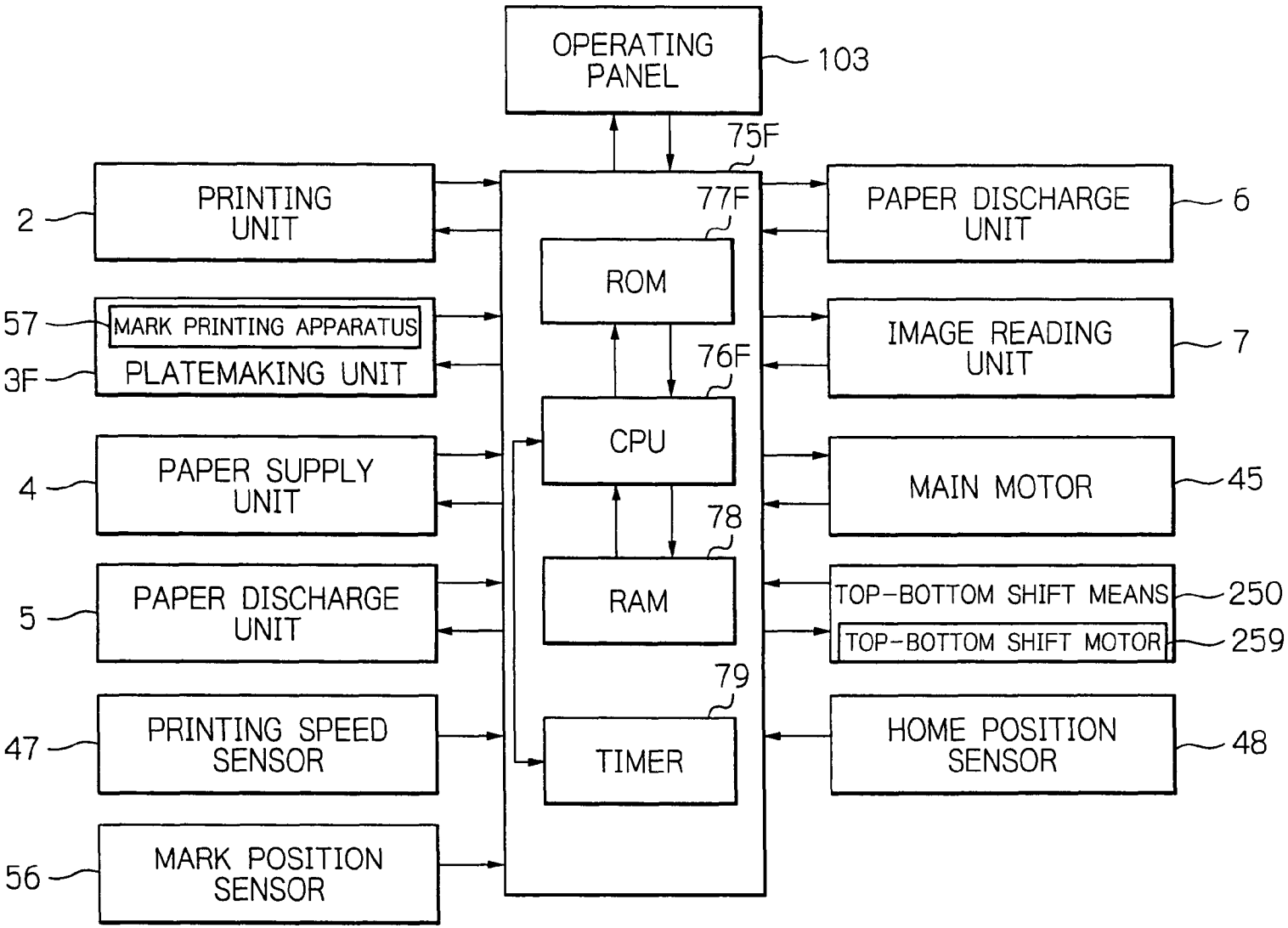
FIG. 18 is a block diagram of a control structure of the fourth embodiment.

FIG. 10, FIG. 17 and FIG. 18 show the fourth embodiment. As shown in FIG. 17, the fourth embodiment differs principally from the third embodiment shown in FIG. 10 and FIG. 15 in the employment of a platemaking unit 3F as a platemaking device comprising a mark printing apparatus 57 as marking means for printing a mark 55 (see FIG. 10) serving as one example of a mark printed on the master 23 for detecting a 1-plate master length instead of the platemaking unit 3 shown in FIG. 1, and the employment of control means 75F instead of control means 75D shown in FIG. 15. The remainder of the configuration is identical to the stencil printing apparatus 1 of the third embodiment. The platemaking unit 3F differs from the platemaking unit 3 shown in FIG. 1 in that it comprises the mark printing apparatus 57.

As shown in FIG. 17, the mark printing apparatus 57 is configured from, for example, an inkjet head and son which, similarly to the example described in the third embodiment, describes a configuration that facilitates printing in black which, from the viewpoint of the reflectivity of light with respect to, for example, the thermoplastic resin film from which the master 23 is configured, ensures good detection sensitivity, as well as printing in a striped-shape parallel to the width direction of the master.

The mark printing apparatus 57 is arranged on a master conveyance path between master cutting means 19 and tension roller pair 20 so that, at a position and a timing directly prior to the trailing edge of the printed master 23 being cut by master cutting means 19 at the completion of platemaking, the marking can be printed in the trailing-edge position of the printed master 23.

As shown in FIG. 18, control means 75F of this embodiment differs principally from control means 75D shown in FIG. 15 in the employment of a CPU 76F instead of the CPU 76D, and the employment of a ROM 77F instead of the ROM 77D. The ROM 77F differs from the ROM 77D shown in FIG. 11 only in the prestorage therein of an operation program for controlling drive means of the mark printing apparatus 57 so that, at a position and timing directly prior to the trailing edge of the printed master 23 being cut by master cutting means 19 at the completion of platemaking, the mark is printed on the trailing-edge position of the same master 23, and a calculation program for implementing a calculation function resembling that implemented by the CPU 76D.

In addition to comprising a function for controlling control means of the mark printing apparatus 57 so that an operation program stored in the ROM 77F is read and, at a position and a timing directly prior to the trailing edge of the printed master 23 being cut by master cutting means 19 at the completion of platemaking, a marking can be printed in the trailing-edge position of the printed master 23, the CPU 76F comprises a calculation function identical to that of the CPU 76D, that is to say, a function for, during normal printing the same as described above, computing a top-bottom shift correction value by performing a calculation based on a master trailing-edge position data signal from the mark position sensor 56 serving as master length data pertaining to the position of the mark 55 of the master 23 on the plate cylinder 9, and controlling the top-bottom shift motor 259 of top-bottom shift means 250 to execute the top-bottom shift movement correction in accordance with the computed top-bottom shift movement correction. The particulars of the computation of the top-bottom shift correction value afforded by the calculation performed by the CPU 76F based on the master trailing-edge position data are identical to those of the CPU 76B and the CPU 76D.

Accordingly, based on the fourth embodiment, because the CPU 76D of control means 75D computes the master position displacement amount by, during normal printing, performing a calculation based on master trailing-edge position data from the mark position sensor 56 pertaining to the position of the trailing edge of the mark 55 of the master 23 on the plate cylinder 9 and, reckoning this as a top-bottom shift correction value, controlling the top-bottom motor 259 of top-bottom shift correction means 250 to execute top-bottom shift correction in accordance with the computed top-bottom shift correction value, even if master position displacement occurs printing position displacement can be prevented from occurring and, in turn, a printed material free of printing position displacement can be produced, master and paper waste can be eliminated, the operation time can be shortened, and the number of operation steps can be reduced. In addition, the fourth embodiment resolves the problems inherent to the third embodiment as described above and, as a result, master cut operability is improved and troublesome operations such as master cutting can be eliminated and, in addition, because detection and measurement of the trailing-edge position of the mark 55 of the master 23 on the plate cylinder 9 is more precise than the detection and measurement of the trailing edge 52 of the master 23 on the plate cylinder 9 of the second embodiment, the precision of the top-bottom shift correction (printing position correction) is improved to the extent to which the detection and measurement is improved.

Naturally, by configuring modifications 11 and 12 of the fourth embodiment in the same way as modification 8 of the third embodiment described with reference to FIG. 13 and modification 7 of the third embodiment described with reference to FIG. 12, identical effects thereto may be afforded by this fourth embodiment. Modifications 11 and 12 of the fourth embodiment are simple to understand and carry out by those skilled in the art and, accordingly, a further description thereof has been omitted.

Modification 13 of Fourth Embodiment

FIG. 19 shows a modification 13 of the fourth embodiment. Modification 13 differs from modification 9 of the third embodiment shown in FIG. 10 and FIG. 16 in the use of a signal from the paper discharge sensor 50 pertaining to copy number, and in the employment of control means 75G instead of control means 75E.

As shown in FIG. 19, control means 75G of this embodiment differs principally from control means 75F shown in FIG. 18 in the employment of a CPU 76G instead of the CPU 76F, and the employment of a ROM 77G instead of the ROM 77F.

ROM 77G differs from ROM 77F shown in FIG. 18 in the prestorage therein of a calculation program for implementing a later-described calculation function peculiar to the CPU 76G, that is to say, a calculation program the same as part of the calculation program ROM 77E shown in FIG. 16.

CPU 76G comprises a function that replaces the function of CPU 76F shown in FIG. 18, that is to say, a function for, during normal printing the same as described above, computing a top-bottom shift correction value by performing a calculation based on a master trailing-edge position data signal from a mark position sensor 56 pertaining to trailing-edge position of a mark 55 of a master 23 on an plate cylinder 9 each time a signal pertaining to copy number from the paper discharge sensor 50 indicates that a preset predetermined copy number has been reached, and controlling the top-bottom shift motor 259 of top-bottom shift means 250 to execute a top-bottom shift correction in accordance with the computed top-bottom shift correction value. The particulars of the computation of the top-bottom shift correction value afforded by the calculation based on the master trailing-edge position data performed by the CPU 76G are identical to those of the CPU 76E.

Accordingly, based on modification 13, because the CPU 76G of control means 75G needs only to implement a calculation the same as the CPU 76E described above during normal printing each time the preset predetermined copy number (for example, copy number the same as shown in FIG. 5) and to control the top-bottom shift motor 259 of the top-bottom shift means 250 to execute the top-bottom shift correction in accordance with the computed top-bottom shift correction value, the need for a calculation the same as described above to be performed for each individual copy number as performed by the CPU 76F shown in FIG. 18 and, in turn, for a top-bottom shift correction command to be issued in response to the computed top-bottom shift correction value is eliminated and, accordingly, the control operation thereof is simplified.

The fourth embodiment also comprises a function the same as that of the control means 75E of the third embodiment shown in FIG. 16, that is to say, the CPU 77G of control means 75G has a function for executing the top-bottom shift correction described above at each rotation of the plate cylinder 9 following temporary interruption of the printing and prior to restart of the same printed master 23 on the plate cylinder 9 (represents modification 14 of the fourth embodiment). In modification 14, and in particular when printing position correction (top-bottom shift correction) for continuous printing is implemented, the mark position sensor 56 is employed to detect and measure the position of the trailing edge of the symbols 55 of the master 23 on the plate cylinder 9 during a period of idling prior to continuous printing employing the same printed master 23 on the plate cylinder 9 being started, and top-bottom shift correction is executed for each individual sheet following the start of printing in accordance with the top-bottom shift correction value obtained by a calculation in the same way as described above. Because the printing position is corrected following detection at every rotation of the plate cylinder 9 for the second and subsequent sheets of paper, printing position displacement does not occur. Accordingly, a top-bottom shift correction (printing position correction) for continuous printing can be executed, and the plate cylinder idling period can be utilized to execute this printing position correction. Naturally, this modification is also able to have application in modification 11 to modification 13 of the fourth embodiment.

While specific embodiments and modifications and so on of the present invention are described above, the technical range disclosed by this invention is not limited to the examples cited by the embodiments and modifications and so on described above, and it is clear to those skilled in the art that configurations based on appropriate combinations thereof may be adopted and that, provided they remain within the scope of the present invention, a variety of embodiments and modifications thereof can be configured in accordance with need and usage aim thereof and so on.

While the printing method and printing apparatus of the present invention are ideal for application in a stencil printing apparatus, they can be adapted for application in, for example, an offset printing apparatus. In addition, they can be adapted for application in what is known as an intaglio printing apparatus in which ink is supplied from the outer side of an impression cylinder as disclosed in Japanese Laid-Open Patent Publication No. H7-17013.

In addition, they can have application in the printing drum and printing apparatus of a 2-drum opposing transfer drum interposed-type 1-pass simultaneous two-side printing system as disclosed in Japanese Laid-Open Patent Publication No. H8-118774, in the printing drum and printing apparatus of the 1-drum separation printing simultaneous reverse-type two-side printing system disclosed in Japanese Laid-Open Patent Publication No. H9-95033, and in the printing drum and printing apparatus of the 1-drum separation printing transfer drum two-side printing system disclosed in Japanese Laid-Open Patent Publication No. H10-129100. Furthermore, they can have application in the 1-pass multi-color printable multi-cylinder printing apparatus disclosed in Japanese Laid-Open Patent Publication No. 2001-191627.

As is described above, the following effects are afforded by the present invention:

(1) Because top-bottom shift correction values are determined by pretesting in accordance with parameters including copy number that affect printed master position displacement in the direction of rotation of a plate cylinder, and during printing, top-bottom shift means are utilized to automatically execute top-bottom shift correction in accordance with the top-bottom shift correction values, even if master position displacement occurs a printed material free of position displacement can be produced, master and paper waste can be eliminated and, in addition, the operation time can be shortened and the number of operation steps can be reduced.

(2) Because control means, each time the copy number counted by copy number counting means reaches a predetermined copy number, reads a top-bottom shift correction value corresponding to a predetermined copy number from storage means, and during printing, controls top-bottom shift means to execute a top-bottom shift correction in accordance with the read top-bottom shift correction value, even if master position displacement occurs a printed material free of position displacement can be produced, master and paper waste can be eliminated and, in addition, the operation time can be shortened and the number of operation steps can be reduced.

(3) Because control means, each time a copy number is counted by copy number counting means as an individual copy number within a predetermined copy number range, computes a top-bottom shift correction value corresponding to each individual copy number by performing a calculation based on a top-bottom shift correction value corresponding to said predetermined copy number and a top-bottom shift correction value corresponding to a next predetermined copy number from storage means, and controls top-bottom shift means to execute top-bottom shift correction in accordance with the computed top-bottom shift correction value, a more detailed and more precise top-bottom shift correction corresponding to individual predetermined copy numbers of a predetermined copy number range can be executed.

(4) Because the top-bottom shift correction values possesses an adjustment value according to master type, plate cylinder type, ink color used in the plate cylinder, printing speed, printing medium type and ink temperature set range, a top-bottom shift correction corresponding to a top-bottom shift correction value that based on printing conditions (parameters) other than copy number and that better approximates the printing conditions of an actual apparatus can be executed.

(5) Because the necessity or unnecessity of top-bottom shift correction by control means can be switched in accordance with user preference or requirement, the operability and convenience of the printing apparatus is improved.

(6) Because control means computes a top-bottom shift correction value by performing a calculation based on master trailing-edge position data detected by master trailing edge detection means, and during printing, utilizes top-bottom shift means to execute top-bottom shift correction in accordance with the computed top-bottom shift correction value, even if master position displacement occurs a printed material free of position displacement can be produced, master and paper waste can be eliminated and, in addition, the operation time can be shortened and the number of operation steps can be reduced.

(7) Based on the configuration described above, because the trailing-edge position of a printed master on a plate cylinder can be precisely detected, measured and calculated in a more stable state, a precise top-bottom shift correction can be executed.

(8) Based on the configuration described above, because the trailing-edge position of a printed master on a plate cylinder can be more precisely detected, measured and calculated in an even more stable state, a more precise top-bottom shift correction can be executed.

(9) Based on the configuration described above, because the calculation performed by control means described above for each individual copy number and, in turn, the need for a top-bottom shift correction command to be issued in accordance with the computed top-bottom shift correction value is eliminated, the control operation can be simplified.

(10) Based on the configuration described above, top-bottom shift correction can be executed utilizing the idling period of the plate cylinder.

(11) Because control means computes a top-bottom shift correction value by performing a calculation based on master length data detected by master mark detection means, and during printing, utilizes top-bottom shift means to execute top-bottom shift correction in accordance with the computed top-bottom shift correction value, even if master position displacement occurs a printed material free of position displacement can be produced, master and paper waste can be eliminated and, in addition, the operation time can be shortened and the number of operation steps can be reduced.

(12) In a printing apparatus comprising a platemaking device comprising platemaking means for making a master and marking means for printing a mark for detecting master length on the master, a plate cylinder around which a printed master made by platemaking means is wrapped, and top-bottom shift means for shifting a position of a printed image directly or indirectly transferred onto a printing medium from a printed master on the plate cylinder in a direction of conveyance of the printing medium, the printed master being mounted so that, when wrapped around said plate cylinder, the mark is arranged on an upstream side in a direction of rotation of the plate cylinder, because control means computes a top-bottom shift correction value by performing a calculation based on master length data detected by master mark detection means, and during printing, causes top-bottom shift means to execute a top-bottom shift correction in accordance with the computed top-bottom shift correction value, even if master position displacement occurs a printed material free of position displacement can be produced, master and paper waste can be eliminated and, in addition, the operation time can be shortened and the number of operation steps can be reduced.

Various modifications will become possible for those skilled in the art after receiving the teachings of the present disclosure without departing from the scope thereof.

What is claimed is:

1. A printing apparatus, comprising:

a plate cylinder around which a printed master is wrapped;

top-bottom shift means for shifting a position of a printed image directly or indirectly transferred onto a printing medium from a printed master on the plate cylinder in a direction of conveyance of the printing medium;

copy number counting means for counting copy number;

storage means for storing a preset top-bottom shift correction value for each predetermined counted copy number; and control means for, each time the copy number counted by said copy number counting means reaches said predetermined counted copy number, reading said top-bottom shift correction value corresponding to said predetermined counted copy number from said storage means and causing said top-bottom shift means to execute a top-bottom shift correction in accordance with the read said top-bottom shift correction value.

2. The printing apparatus as claimed in claim 1, wherein said control means for, each time the copy number is counted by said copy number counting means as an individual copy number within said predetermined counted copy number range, computing said top-bottom shift correction value corresponding to said individual copy number by performing a calculation based on said top-bottom shift correction value corresponding to said predetermined counted copy number and said top-bottom shift correction value corresponding to a next predetermined counted copy number read from said storage means, and causing said top-bottom shift means to execute said top-bottom shift correction in accordance with the computed top-bottom shift correction value.

3. The printing apparatus as claimed in claim 1, wherein said top-bottom shift correction value possesses an adjustment value according to master type.

4. The printing apparatus as claimed in claim 1, wherein said top-bottom shift correction value possesses an adjustment value according to type of said printing cylinder.

5. The printing apparatus as claimed in claim 1, further comprising ink supply means for supplying ink to a printed master of said print cylinder, wherein said top-bottom shift correction value possesses an adjustment value according to ink color used on said printing cylinder.

6. The printing apparatus as claimed in claim 1, wherein said top-bottom shift correction value possesses an adjustment value according to printing speed.

7. The printing apparatus as claimed in claim 1, wherein said top-bottom shift correction value possesses an adjustment value according to type of printing medium.

8. The printing apparatus as claimed in claim 1, further comprising ink supply means for supplying ink to a printed master of said print cylinder, wherein said top-bottom shift correction value possesses an adjustment value according to ink temperature set range.

9. The printing apparatus as claimed in claim 1, further comprising switching means controlled by a user for switching between necessity or unnecessity of implementation of said top-bottom shift correction by said control means.

* * * * *